US006363674B1

(12) United States Patent
Carver

(10) Patent No.: US 6,363,674 B1
(45) **Date of Patent: *Apr. 2, 2002**

(54) PREMANUFACTURED STRUCTURAL BUILDING PANELS

(76) Inventor: Tommy Lee Carver, 1754 Wildwood Dr., Charlotte, NC (US) 28214

( * ) Notice: Subject to any disclaimer, the term of this patent is extended or adjusted under 35 U.S.C. 154(b) by 0 days.

This patent is subject to a terminal disclaimer.

(21) Appl. No.: 09/613,982

(22) Filed: Jul. 11, 2000

Related U.S. Application Data

(63) Continuation-in-part of application No. 09/226,883, filed on Jan. 7, 1999, now Pat. No. 6,085,479, which is a continuation-in-part of application No. 08/976,734, filed on Nov. 25, 1997, now abandoned.

(51) Int. Cl.[7] ..... E04C 1/00

(52) U.S. Cl. ..... 52/309.8; 52/794.1; 52/309.12; 52/309.13; 52/800.12; 52/781.3; 52/404.4; 52/407.3; 52/270; 52/309.7; 52/309.8

(58) Field of Search ..... 52/309.8, 794.1, 52/309.12, 309.13, 800.12, 781.3, 404.4, 407.3, 270, 309.7

(56) References Cited

U.S. PATENT DOCUMENTS

| | | | |
|---|---|---|---|
| RE25,364 | E | 4/1963 | Jacobson |
| 3,507,738 | A | 4/1970 | Prusinski et al. |
| 3,679,529 | A | 7/1972 | Prusinski et al. |
| 3,965,633 | A | 6/1976 | Carroll |
| 4,063,395 | A | 12/1977 | Stewart et al. |
| 4,065,893 | A | 1/1978 | Epes |
| 4,154,042 | A | 5/1979 | Epes |
| 4,236,361 | A | 12/1980 | Boden |
| 4,577,445 | A | 3/1986 | Price |
| 4,633,634 | A | 1/1987 | Nemmer et al. |
| 4,674,250 | A | 6/1987 | Altizer |
| 4,774,794 | A | 10/1988 | Grieb |
| 5,048,248 | A | 9/1991 | Ting |
| 5,088,259 | A | 2/1992 | Myers |
| 5,265,389 | A | 11/1993 | Mazzone et al. |
| 5,524,400 | A | 6/1996 | Schmechel |
| 5,758,463 | A | 6/1998 | Mancini, Jr. |

*Primary Examiner*—Beth A. Stephan
*Assistant Examiner*—Dennis L. Dorsey
(74) *Attorney, Agent, or Firm*—Alston and Bird LLP

(57) ABSTRACT

There is provided a premanufactured structural building panel system for effectively promoting the efficient construction of the exterior wall members of a building having improved insulation, sound absorption, fire retardant and structural properties. The premanufactured structural building panels are made of a pair of C-shaped structural channels having first and second flanges. The channels are secured to a foam insulation member to form the panels. A fire retarding member can be secured to a flange of at least one of the channels to define an interior surface. The structural panels are supported on wall support members and connected to each other in a side-by-side fashion to form an exterior wall member of a building. The exterior wall members include vertical sidewalls, a horizontal roof and ceiling wall, and a pitched roof system. The interior surface of the walls can be prepared for finishing. Affixed to the exterior of the wall members is a weatherable covering.

59 Claims, 15 Drawing Sheets

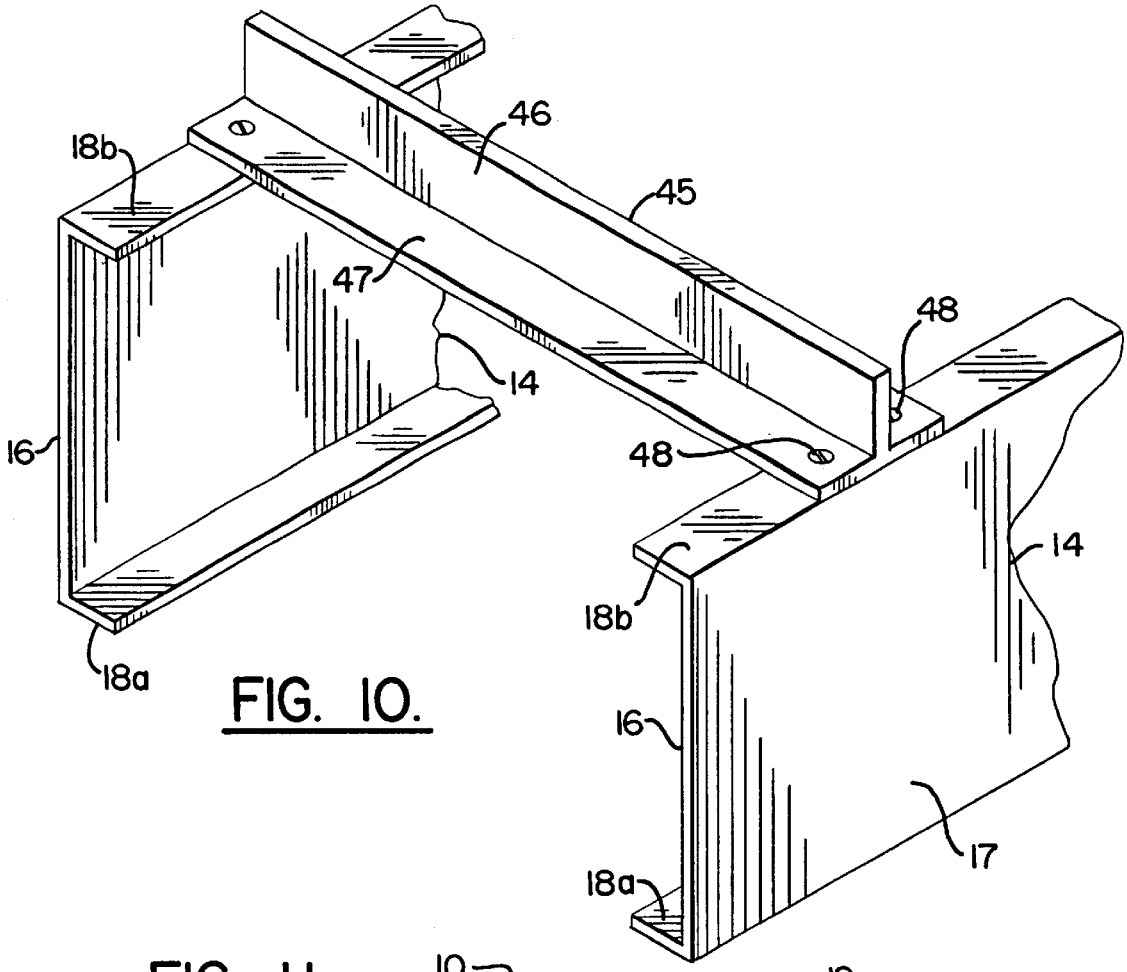
FIG. 10.
FIG. 11.
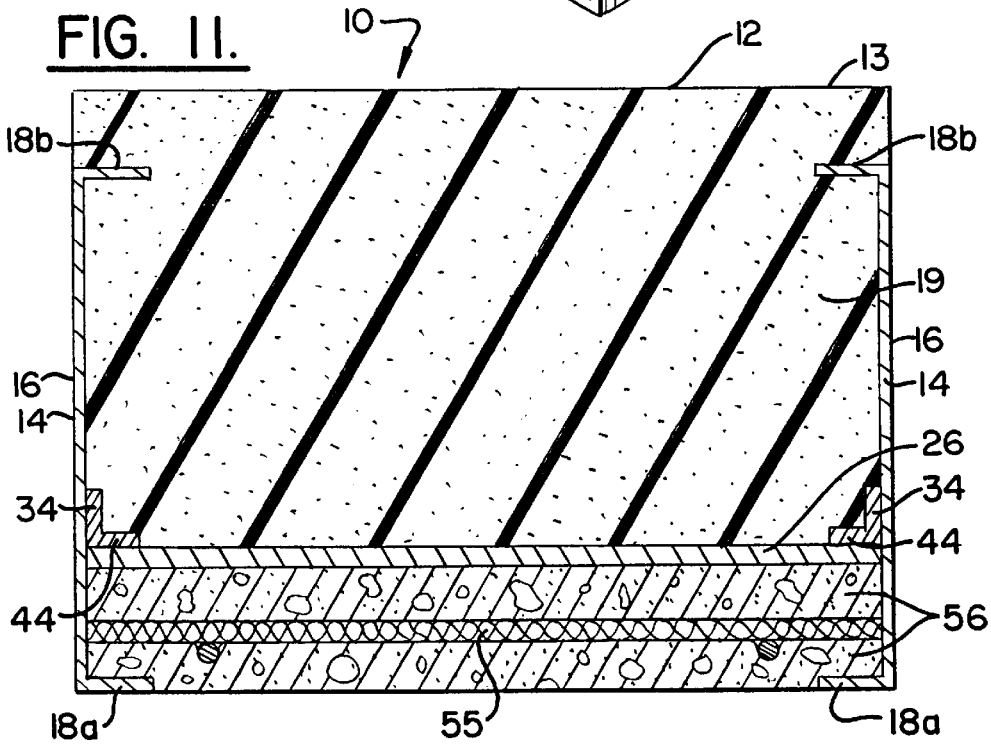

PREMANUFACTURED STRUCTURAL BUILDING PANELS

CROSS-REFERENCES TO RELATED APPLICATIONS

This application is a continuation-in-part of U.S. patent application Ser. No. 09/226,883, filed on Jan. 7, 1999, now U.S. Pat. No. 6,085,479, which is a continuation-in-part of U.S. patent application Ser. No. 08/976,734, filed on Nov. 25, 1997, which is now abandoned, both of which are hereby incorporated herein in their entirety by reference.

FIELD OF THE INVENTION

The present invention relates to premanufactured structural building panels for the construction of insulated exterior walls. More particularly, the present invention relates to a system of insulated premanufactured structural building panels that can be arranged in a side-by-side fashion to form one or more exterior walls of a building.

BACKGROUND OF THE INVENTION

The floors of conventional commercial and residential buildings are commonly framed using a plurality of horizontally extending structural support beams which are supported on multiple load bearing columns or wood studs. The walls are constructed using uniformly spaced metal or wood studs that extend vertically between the floors of the building.

The roof system of a conventional commercial building includes uniformly spaced joists spanning the length between pairs of parallel support beams. A metal deck is placed on top of the uniformly spaced joists. Panels of insulation board are then layered on top of the deck. The exterior covering of the roof can be formed using a polymer sheeting placed on top of both the deck and the insulation board and secured with ballast or an adhesive.

The roof system of a conventional residential building includes uniformly spaced joists spanning the length between pairs of parallel support beams. Plywood may be placed on top of the uniformly spaced joists. Metal or wood trusses are then erected above the joists to form the framing for the roof. Exterior plywood sheathing is applied on top of the trusses and an exterior covering, such as a roofing felt and either asphalt or wood shingles, is then secured to the exterior surface of the sheathing.

The exposed underside of a conventional commercial or residential roof system is generally not a smooth surface, but instead reveals the exposed joists and deck. Additional materials, such as gypsum coreboard or fiberglass ceiling tiles, in conjunction with a metal grid, can be utilized to form the finished ceiling. In either case, an air space will generally remain between the ceiling and the exposed roof structure. Such ceiling and roof systems can have less than desirable insulation properties and thus additional insulation is often installed. Additionally, conventional ceiling and roof systems have limited sound attenuation and fire retardant properties.

The exterior facade of the building, which may include brick, concrete, stone, metal or wood, is formed adjacent to the studs. Conventional batt insulation is placed between the studs and the interior is then covered with gypsum coreboard to form a smooth surface for finishing. The batt insulation in the wall has a tendency to sag, which can also result in decreased insulation properties and limited sound attenuation, in addition to having limited fire retardant properties.

Accordingly, the construction of conventional sidewalls, ceiling walls and roof systems requires a variety of materials, some of which are quite heavy. The installation of these materials can also be complex and require varying degrees of precision. Thus, installation of these materials is often labor intensive, which can result in higher costs being associated with the construction of these types of buildings.

In seeking better materials for constructing the walls of a building, several forms of premanufactured building panels have been suggested. One such example of a building panel is disclosed in U.S. Pat. No. 5,265,389 to Mazzone, et al. which discloses an exterior curtain wall panel. The panel has a pair of opposed end caps consisting of channels of light gauge galvanized steel and a foam core of expanded polystyrene with a thickness greater than the width of the channels. The structural strength for the panel is provided by multiple open box type tubes extending vertically along the height of the panel and located within the foam core. However, the panel does not provide fire retardation. In addition, the upper and lower channels are exposed to external conditions and the patent discloses that the channels are thus preferably made from rust resistant galvanized steel, which can be expensive if used in all applications.

Another example of a building panel is disclosed in U.S. Pat. No. 5,524,400 to Schmechel which discloses a sidewall assembly for a building. The sidewall assembly includes a plurality of expanded polystyrene panels. Each panel has side and end surfaces which define grooves therein. Each panel has a pair of opposed U-shaped side supports which interface with a corresponding groove extending along one of the longitudinally extending laterally displaced sides of the panel. Adjacent panels are secured together by a pair of opposed U-shaped end supports which interface with corresponding grooves extending along the laterally extending longitudinally displaced ends of the panels and which are secured to the side supports by suitable fasteners. Adjacent panels may also be secured together by joining the abutting side supports with suitable fasteners. However, as with the Mazzone patent, the sidewall assembly disclosed in the Schmechel patent does not provide for fire retardation. In the event of a fire, the expanded polystyrene panels of the sidewall assembly will melt thus removing the internal reinforcement of the U-shaped side and end supports which is necessary to prevent displacement of the supports. In the case of horizontal roof and ceiling panels, which are not disclosed in Schmechel, strength is especially important.

Thus, there is a need for improved building materials for use in the construction of exterior walls, such as sidewalls, ceiling walls and roof systems of buildings. Such materials must be capable of being efficiently installed to reduce labor costs while at the same time providing adequate insulation properties, sound attenuation, fire retardation and structural strength. These materials should also be protected from the weather.

SUMMARY OF THE INVENTION

The present invention provides a premanufactured structural building panel system whereby the structural panels can be constructed inexpensively and efficiently off-site for subsequent installation at the construction site. The individual structural panels are made of a pair of C-shaped structural channels partially encompassing a foam insulation member. The structural panels are connected to each other in a side-by-side fashion to form an exterior wall, including a roof, of a building.

In one embodiment, the premanufactured structural building panels include a pair of structural channels extending longitudinally in parallel directions. Each of the channels is of a generally C-shaped cross section which is defined by a web portion having a laterally outer surface and by first and second flanges connected at opposite ends of the web portion. Where the building panels are used to form a roof and ceiling wall, a plurality of retaining members can be extended between the second flanges of the channels to provide additional structural strength. Each of the channels faces the other such that the flanges extend from the respective web portion in a direction towards the opposing channel.

Advantageously, a fire retarding board extends between the web portions of the channels such that it is adjacent to the first flanges of the channels. The fire retarding board has a surface facing the interior of the building and an opposite exteriorly facing surface.

The structural channels also include third flanges extending from the web portions of each of the channels. The third flanges are located between the first and second flanges and each third flange extends from the respective web portion in a direction towards the other channel. The third flanges are secured to the exteriorly facing surface of the fire retarding board.

A foam insulation member extends between the web portions of the channels. The insulation member has an interiorly facing surface adjacent the exteriorly facing surface of the fire retarding board and an opposite exteriorly facing surface. The insulation member also has a pair of opposite lateral sides, each of which defines a groove therein. The second flanges of both channels are engaged within the grooves and are thus protected from the elements.

The structural building panels are connected to wall support members and are arranged in a side-by-side relationship to form an exterior wall member such that the lateral sides of each of the foam insulation members are generally in abutting contact with the corresponding lateral sides of adjacent panels and the laterally outer surface of the web portions of the channels are in abutting contact with and connected to the corresponding laterally outer surface of the web portions of adjacent channels. As such, the present invention advantageously provides an exterior wall member wherein the channels (which are preferably formed of steel) are protected from the elements by the foam members and any rain or moisture impinging on the exterior surface of the exterior wall member will be prevented from coming into contact with the channels. In addition, the fire retarding board and third flanges advantageously provide internal structural support to the channels in the event a fire melts the foam insulation member.

In another embodiment of the present invention, the panels include a pair of structural channels extending longitudinally. Each of the channels has a generally C-shaped cross section defined by a web portion having a laterally outer surface defining a plane and by first and second flanges connected at opposite ends of the web portion. In one embodiment, the web portion of at least one of the channels defines an aperture. Each of the flanges has first and second portions. The first portion of each flange extends from the web portion in a direction towards the other of the channels. The second portion of each flange of each channel extends from the first portion in a direction towards the other of the flanges of the same channel.

A foam insulation member extends between the web portions of the channels and has first and second oppositely facing surfaces. The foam insulation member can be formed from polyurethane, polystyrene, polypropylene, polyisocyanurate or polyethylene. The first facing surface of the foam insulation member corresponds to the first flanges of the channels and the second facing surface corresponds to the second flanges of the channels. Advantageously, the first and second oppositely facing surfaces of the foam insulation member are each adapted to engage the corresponding first and second flanges to thereby secure the channels to the foam insulation member. In one embodiment, the first portions of the flanges of the channels define exteriorly facing surfaces that are generally coplanar with the corresponding facing surfaces of the foam insulation member. A fire retarding board can be connected to the exteriorly facing surface defined by the first portion of at least one of the first flanges of one of the channels to provide the necessary fire rating to the building panel, as well as structural support to the channels in the event a fire melts the foam insulation member. The fire retarding board also provides a relatively flat surface that can be prepared to receive paint or another finish.

The structural building panels are connected to wall support members and are arranged in a side-by-side relationship to form an exterior wall member such that the laterally outer surface of the web portions of the channels are in abutting contact with and connected to the corresponding laterally outer surface of the web portions of adjacent channels. As such, the present invention advantageously provides an exterior wall member that can be efficiently fabricated, transported and installed to form an insulated building.

In another embodiment of the present invention, the panels include a pair of structural channels extending longitudinally. Each of the channels has a generally C-shaped cross section defined by a web portion having a laterally outer surface defining a plane and by first and second flanges connected at opposite ends of the web portion. In one embodiment, the web portion of at least one of the channels defines an aperture. The first flanges extend from the respective web portions in a direction towards the other of the channels. The second flanges have first and second portions. The first portion of each second flange extends from the respective web portion in a direction towards the other of the channels. The second portion of each second flange of each channel extends from the first portion in a direction towards the first flanges of the same channel.

A fire retarding board having lateral side edges extends between the web portions of the channels such that it is adjacent the first flanges of the channels. The fire retarding board has a surface facing the interior of the building and an opposite exteriorly facing surface. In one embodiment, the fire retarding board comprises gypsum coreboard.

The structural channels also include third flanges extending from the web portions of each of the channels. The third flanges are located between the first and second flanges and each third flange extends in a direction towards the other of the channels. The third flanges are secured to the exteriorly facing surface of the fire retarding board.

A foam insulation member extends between the web portions of the channels. The foam insulation member can be formed from polyurethane, polystyrene, polypropylene, polyisocyanurate or polyethylene. The foam insulation member has an interiorly facing surface adjacent the fire retarding board and an opposite exteriorly facing surface. The exteriorly facing surface of the foam insulation member is adapted to engage the second flanges to thereby secure the channels to the foam insulation member. In one embodiment, the first portions of the second flanges of the channels define exteriorly facing surfaces that are generally coplanar with the corresponding facing surfaces of the foam insulation member.

In another embodiment, the third flanges have first and second portions. The first portion of each of the third flanges extends from the web portion in a direction towards the other of the channels. The second portion of each of the third flanges extends from the first portion in a direction towards the second flange of the same channel and wherein the exteriorly facing surface of the foam insulation member is adapted to engage the third flanges.

The structural building panels are connected to wall support members and are arranged in a side-by-side relationship to form an exterior wall member such that the laterally outer surface of the web portions of the channels are in abutting contact with and connected to the corresponding laterally outer surface of the web portions of adjacent channels. As such, the present invention advantageously provides an exterior wall member that can be efficiently fabricated, transported and installed. In addition, the fire retarding board and third flanges advantageously provide internal structural support to the channels in the event a fire melts the foam insulation member.

In still another embodiment of the present invention, the panels include a pair of structural channels extending longitudinally. Each of the channels has a generally C-shaped cross section defined by a web portion having a laterally outer surface defining a plane and by first and second flanges connected at opposite ends of the web portion. In one embodiment, the web portion of at least one of the channels defines an aperture. The first flanges extend from the respective web portions in a direction towards the other of the channels. The second flanges have first and second portions. The first portion of each second flange extends from the respective web portion in a direction towards the other of the channels. The second portion of each second flange of each channel extends from the first portion in a direction towards the first flanges of the same channel.

At least one retaining member extends between the web portions of each of the channels between the first and second flanges. The structural building panel includes at least one fire retarding board having lateral side edges extending between the web portions of the channels adjacent the first flanges of the channels such that the lateral side edges are engaged between the first flanges and the at least one retaining member. The at least one fire retarding board has a surface facing the interior of the building and an opposite exteriorly facing surface. In one embodiment, the fire retarding board comprises gypsum coreboard.

A foam insulation member extends between the web portions of the channels. The foam insulation member can be formed from polyurethane, polystyrene, polypropylene, polyisocyanurate or polyethylene. The foam insulation member has an interiorly facing surface adjacent the at least one fire retarding board and an opposite exteriorly facing surface. The exteriorly facing surface of the foam insulation member is adapted to engage the second flanges to thereby secure the channels to the foam insulation member. In one embodiment, the first portions of the second flanges of the channels define exteriorly facing surfaces that are generally coplanar with the corresponding facing surfaces of the foam insulation member.

The structural building panels are connected to wall support members and are arranged in a side-by-side relationship to form an exterior wall member such that the laterally outer surface of the web portions of the channels are in abutting contact with and connected to the corresponding laterally outer surface of the web portions of adjacent channels. As such, the present invention advantageously provides an exterior wall member that can be efficiently fabricated, transported and installed. In addition, the fire retarding board and retaining member advantageously provide internal structural support to the channels in the event a fire melts the foam insulation member.

A plurality of adjacent premanufactured structural building panels can be positioned together to form an exterior wall member of a building. The exterior wall members of a building according to the present invention can include vertical sidewalls, a horizontal roof and ceiling wall, or a slanted roof having a predetermined pitch. As such, the entire exterior of a building can be comprised of building panels according to the invention. In contrast to the exterior curtain wall panel of the Mazzone patent and the sidewall assembly of the Schmechel patent, the building panels of the present invention are interchangeable as sidewalls or horizontal roof and ceiling walls since the panels have sufficient fire retardant properties and internal structural strength. The interior surface of the wall members are prepared for finishing using a finishing board, such as drywall, connected to the first flanges of the channels. The interiorly facing surface of the finishing board has a finishable surface.

A security wall can also be constructed using the building panels of the present invention. The security wall can include a layer of cementitious material retained between the fire retarding board and the first flanges of the channels. Reinforcing members extending between the web portions of the channels may be secured within the layer of cementitious material.

A weatherable covering can be provided on the exterior of the wall members. For the roof and ceiling wall in a commercial building, the covering is made of an elastomeric roof coating placed on the exteriorly facing surface of the foam insulation member. Where the wall member being constructed is a sidewall, the weatherable covering may comprise a weatherable plaster applied directly to the exteriorly facing surface of the foam insulation members. For a roof system in a residential building, the weatherable covering may comprise roof shingles applied to an exterior plywood sheathing.

At least one sound attenuating board can also advantageously extend between the web portions of the channels. The sound attenuating board has a surface facing the interior of the building and an opposite exteriorly facing surface adjacent the interiorly facing surface of the fire retarding board. In another embodiment, the at least one sound attenuating board is secured to the at least one fire retarding board such that the at least one sound attenuating board has a surface facing the interior of the building and an opposite exteriorly facing surface adjacent the at least one fire retarding board.

The present invention also provides a method of manufacturing an insulated structural building panel including positioning a pair of longitudinally extending structural channels adjacent to one another to define part of an at least partially enclosed space. At least one form is positioned adjacent to the channels to thereby define an at least partially enclosed space. Thereafter, an insulating foam is inserted into the at least partially enclosed space defined by the at least one form and the channels. In one embodiment, the inserting step includes injecting the insulating foam through an aperture defined by the web portion of one of the channels and allowing the insulating foam to expand. In another embodiment, the inserting step comprises injecting the insulating foam through an aperture defined by the at least one form. The at least one form is then held in place adjacent the channels until the insulating foam has cured to thereby secure the channels to the foam insulation. The at least one form can then be removed from the channels.

In another embodiment of the present invention, the method of manufacturing an insulated structural building panel includes securing a pair of longitudinally extending angle members along opposite edges of the first side of a fire retarding board. A pair of longitudinally extending structural channels are positioned adjacent to one another. The fire retarding board and angle members are placed between the pair of longitudinally extending structural channels such that the fire retarding board extends between the channels to thereby define part of an at least partially enclosed space. At least one form is positioned adjacent to the channels to thereby define an at least partially enclosed space. An insulating foam is inserted into the at least partially enclosed space defined by the at least one form and the channels. In one embodiment, the inserting step includes injecting the insulating foam through an aperture defined by the web portion of one of the channels and allowing the insulating foam to expand. In another embodiment, the inserting step includes injecting the insulating foam through an aperture defined by the at least one form. The at least one form is held in place adjacent the channels until the insulating foam has cured to thereby secure the channels to the foam insulation. The at least one form is then removed from the channels.

In still another embodiment of the present invention, the method of manufacturing an insulated structural building panel includes securing at least one retaining member along a lateral side of a fire retarding board. A pair of longitudinally extending structural channels are then positioned adjacent to one another to define part of an at least partially enclosed space. The fire retarding board and at least one retaining member are then placed between the pair of longitudinally extending structural channels such that the fire retarding board and at least one retaining member extend between the channels. At least one form is positioned adjacent to the channels to thereby define an at least partially enclosed space. An insulating foam is inserted into the at least partially enclosed space defined by the at least one form and the channels. In one embodiment, the inserting step includes injecting the insulating foam through an aperture defined by the web portion of one of the channels and allowing the insulating foam to expand. In another embodiment, the inserting step includes injecting the insulating foam through an aperture defined by the at least one form. The at least one form is held in place adjacent the channels until the insulating foam has cured to thereby secure the channels to the foam insulation. The at least one form is then removed from the channels.

Accordingly, there has been provided a premanufactured structural building panel allowing for the efficient construction of a building in terms of both labor and material costs. The structural building panels further provide fire resistance and an improved insulation value, and can be easily adapted to provide improved sound attenuation. In addition, the panels are generally corrosion resistant once installed.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, and which are not necessarily drawn to scale, wherein:

FIG. 10 is a partial perspective view illustrating another preferred embodiment of the retaining member of a premanufactured structural building panel according to the present invention as used to form a roof system;

FIG. 11 is a plan view illustrating an embodiment of a premanufactured structural building panel according to the present invention as used to form a sidewall having a security barrier;

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
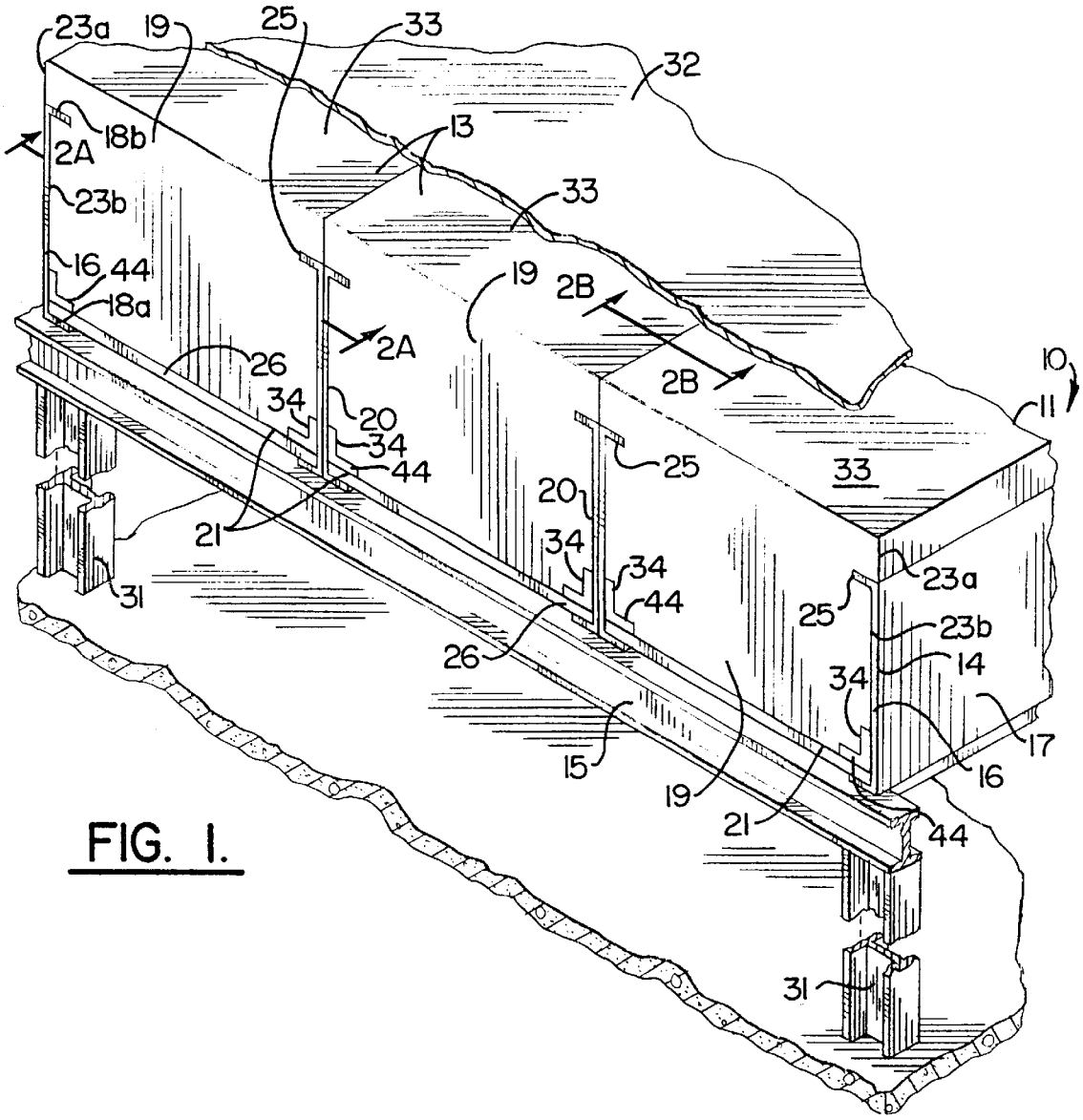
FIG. 1 is a partial perspective view illustrating an embodiment of a premanufactured structural building panel system according to the present invention as used to form a roof and ceiling wall.
Figure 3:
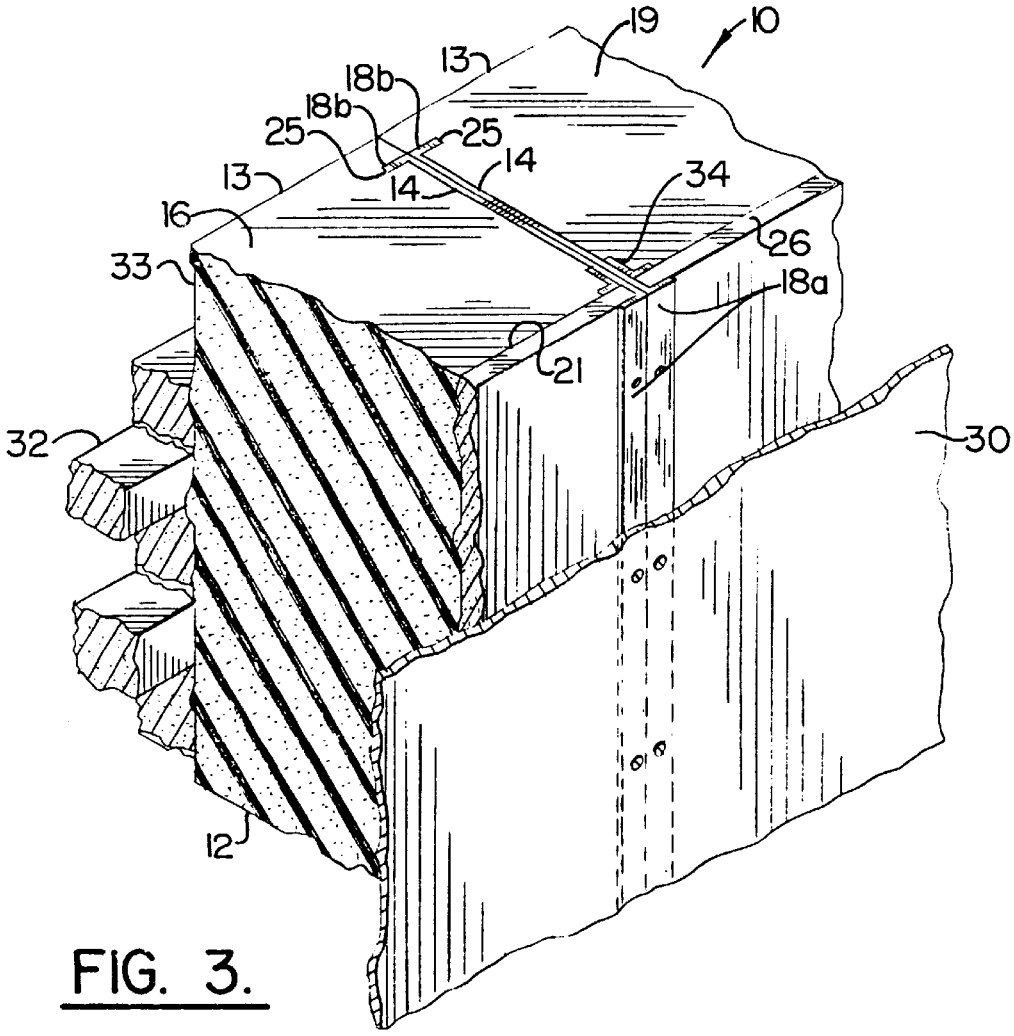
FIG. 3 is a partial perspective view illustrating an embodiment of the premanufactured structural building panel system according to the present invention as used to form an exterior sidewall.

Referring now to the drawings and in particular FIG. 1, there is shown an exterior wall member 10, in this case a horizontal roof and ceiling wall 11, constructed using premanufactured structural building panels 13 according to one embodiment of the present invention. Notably, as shown in FIG. 3, the premanufactured structural building panels 13 can also be used in the construction of vertical sidewalls 12. The interchangeability of the premanufactured structural building panels 13 for use in the construction of either a roof and ceiling wall 11 or a sidewall 12 considerably reduces the number of different materials needed to construct the exterior of a building as compared to conventional wall, roof and ceiling construction.

Figure 2A:
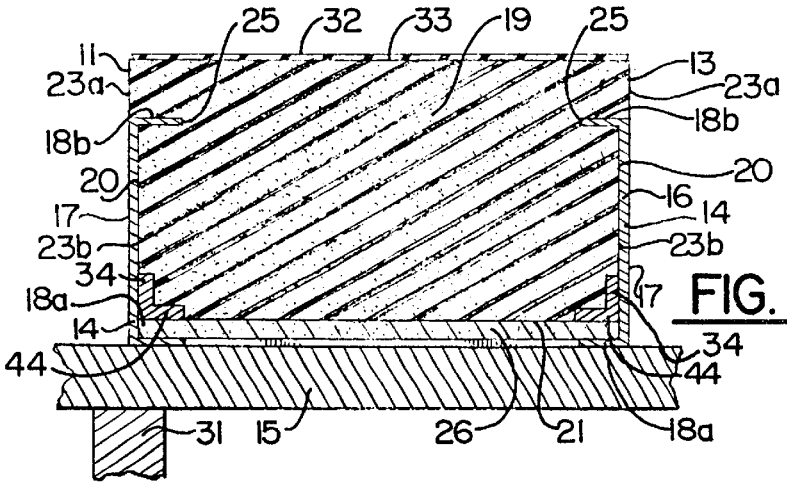
FIG. 2A is a partial cross section of the premanufactured structural building panel system and wall support member of FIG. 1 taken along lines 2A—2A.
Figure 2B:
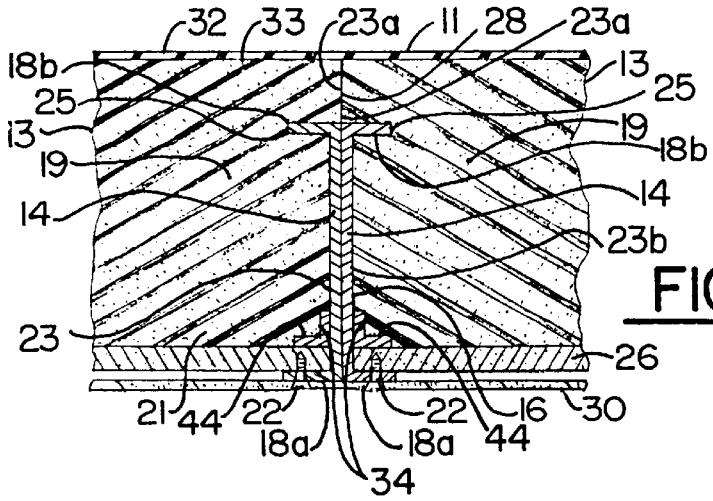
FIG. 2B is a partial cross section of the premanufactured structural building panel system of FIG. 1 taken along lines 2B—2B.

As can be seen in FIGS. 2A and 2B, the structural building panels 13 include a pair of structural channels 14 extending longitudinally in parallel directions and being supported on a wall support members 15. Each of the channels 14 is of a generally C-shaped cross-section which is defined by a web portion 16 having a laterally outer surface 17 and by first and second flanges 18*a,b* extending from opposite ends of the web portion 16 in a direction towards the opposing channel 14.

The channels 14 are advantageously standard steel channels as known in the art. The specifications of the channels 14 are dependent upon the span between wall support members 15 and any specific loading requirements, including wind loads. In a preferred embodiment, channels having a height of 10 inches and formed of 16 gauge steel are used as channels 14 in the construction of structural building panels 13 for horizontal spans of up to 30 feet. The channels 14 used in the construction of structural building panels 13 for installation as a vertical sidewall 12 having a span of up to 25 feet between wall support members 15 are preferably 8 inch, 16 gauge steel channels.

As illustrated in FIG. 1, a pair of angle members 34 having a generally L-shaped cross section defined by two perpendicular arm portions provide third flanges 44 extending from the web portions 16 of each of the channels 14 in a direction towards the other channel. The angle members are preferably formed of steel. The angle members are located between the first and second flanges 18*a,b* and are connected to the web portions 16 of the channels 14 using conventional welding techniques or suitable fasteners. In a preferred embodiment, the angle members 34 are 1.5 inch by 1.5 inch conventional angle iron which will provide additional structural strength to the channels.

As shown in FIG. 1, each panel includes at least one fire retarding board 26 having lateral side edges extending between the web portions 16 of the channels 14 adjacent the first flanges 18*a* of the channels such that the lateral side edges are engaged between the first and third flanges. The fire retarding board has a surface facing the interior of the building and an opposite exteriorly facing surface. The third flanges 44 are secured to the exteriorly facing surface of the fire retarding board by adhesive or suitable fasteners. In a preferred embodiment, the fire retardant board 26 is a one-inch thick panel of gypsum coreboard, but the thickness of the fire board can vary depending on the required fire rating.

For each panel 13, a foam insulation member 19 extends in part between the web portions 16 of the channels 14. The foam insulation members 19 preferably have an interiorly facing surface 21 laminated to the fire retarding board 26 and an exteriorly facing surface 33. The foam insulation member 19 may be formed of expanded polystyrene (EPS) or other suitable lightweight and inexpensive insulation materials. The foam insulation member is preferably installed in segments of approximately 4 to 8 feet. The width and thickness of the foam insulation member 19 will vary depending upon the span between wall support members 15 and any specific loading or insulation requirements. In a preferred embodiment, the foam insulation member 19 has a width of approximately 2 feet while the thickness of the foam insulation member 19 is varied depending on whether the exterior wall 10 to be constructed is a vertical sidewall 12 or a roof and ceiling wall 11. The thickness of a foam insulation member 19 in a structural building panel 13 for installation as a roof and ceiling wall 11, as shown in FIG. 1, will preferably range from 10 to 12 inches, while the thickness of the foam insulation member 19 for a structural building panel 13 to be installed as a vertical sidewall 12, as shown in FIG. 3, will preferably range from 7 to 8 inches. In either case, the foam insulation members 19 are lighter than conventional materials which can result in reduced labor costs in the construction of the premanufactured structural building panels 13 and later in the installation of the structural panels 13 to form an exterior wall 10.

As shown in FIG. 2A and 2B, the foam insulation members 19 have a pair of opposite lateral sides 20 which are notched at an adequate distance, preferably about 1–3 inches, from the exteriorly facing surface 33 to form grooves 25. The grooves 25 receive the second flange 18*b* of each channel 14 thus preventing any dewpoint moisture or other exterior ambient weather conditions from contacting the channels 14. The foam insulation members are also notched approximately ⅛ inch along the portion of the lateral sides adjacent to the interiorly facing surface 21 and along the portion of the interiorly facing surface adjacent to the lateral sides to receive the angle members secured to the fire retarding board 26. These notches may be formed by cutting two pieces of foamed material having rectangular cross sections along the length of the foam insulation member or by merely compressing the foamed material with a hammer or the like after the angle members have been positioned.

The opposite lateral sides 20 of the foam insulation members 19 are divided by the grooves 25 into exterior and interior portions 23*a,b*. The thickness of the exterior portions 23*a* is such that the exterior portions 23*a* are generally even with the laterally outer surfaces 17 of the web portions 16 of the respective channels 14, and generally extend in the planes defined by the laterally outer surfaces 17. The channels may be compressed together using a hydraulic press or using a hammer or the like after the channels and second flanges 18*b* have been positioned.

A substantially planar surface is thus created along both of the lateral sides of each of the premanufactured structural building panels 13 which provides a consistent interface along the length of adjacent structural building panels when the structural panels are installed in a side-by-side relationship. This consistent interface assists in preventing the exterior ambient weather conditions from contacting the channels 14. Specifically, any rain or moisture will be prevented from coming into contact with the structural channels 14 because of the intervening and abutting portions of the foam insulation members 19. Additionally, the foam insulation members 19 advantageously decrease the amount of convective heat transfer compared to conventional insulation, and thus, also provide improved insulation properties.

As shown in FIG. 1, each end of the individual structural building panels 13 is supported on a wall support member 15 that is in turn supported on columns 31. The structural building panels 13 are connected to the support member 15 by steel fastening techniques such as tack welding. The building panels 13 are arranged in a side-by-side relationship to form an exterior wall member 10, in this case a roof and ceiling wall 11. More generally, the entire exterior of a building can be formed using the premanufactured structural building panels 13 according to the invention by constructing four vertical sidewalls 12 and a roof and ceiling wall 11.

In the case of a vertical sidewall 12, the panels can be secured to the foundation and slab (not shown) of the building by forming an L-shaped rim along the length of the foundation. A structural L-channel corresponding to the L-shaped rim can be anchored to the foundation by anchor bolts or other suitable fasteners. The L-channel provides a planar surface for supporting the end of the building panel 13, which end can be secured to the L-channel by welding or suitable fasteners. In the event any water were to penetrate the panel, the L-channel provides a drain for preventing water from entering the building.

Figure 8:
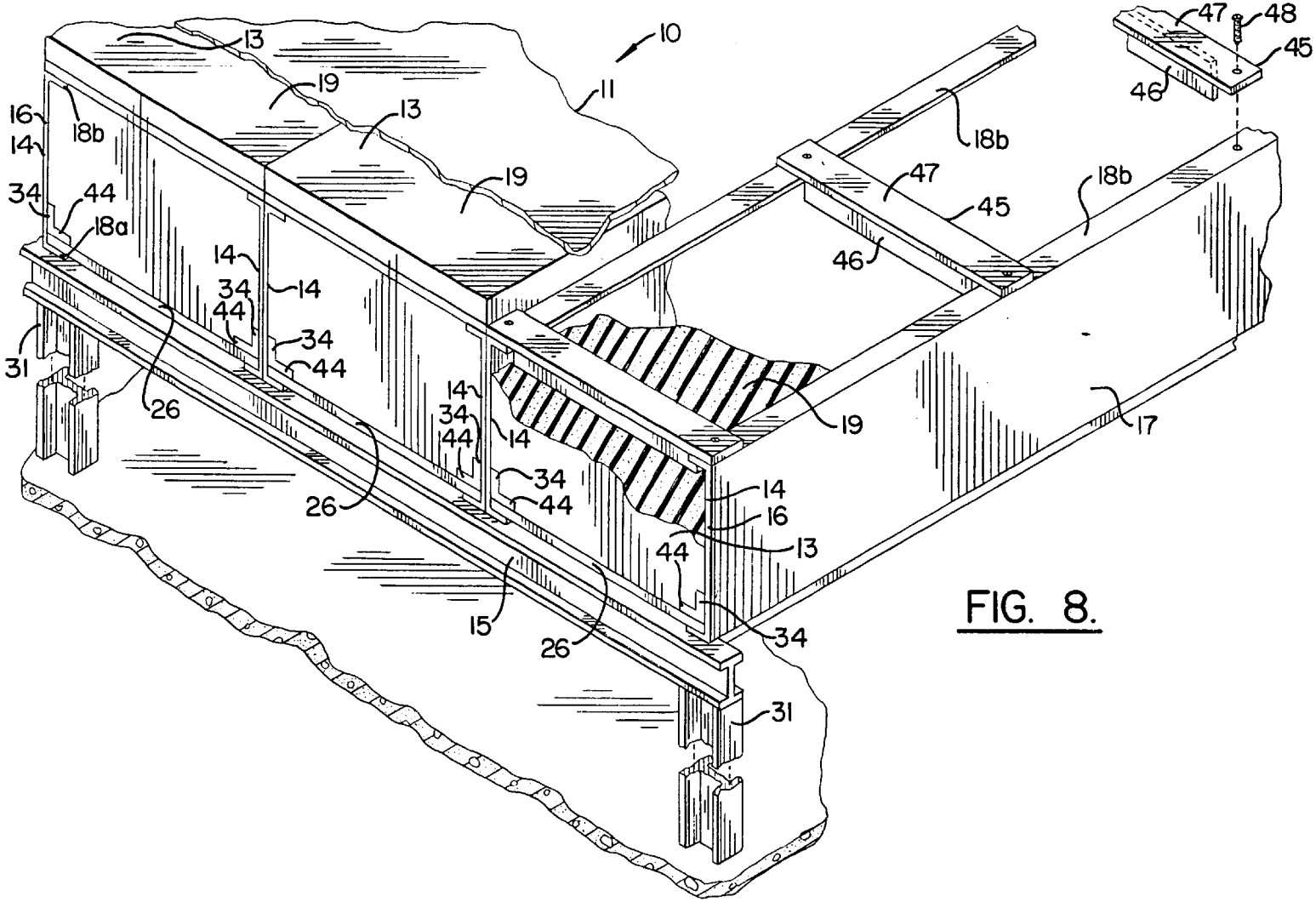
FIG. 8 is a partial perspective view illustrating an embodiment of the premanufactured structural building panel system according to the present invention as used to form a roof system.

As shown in FIG. 8, for a roof and ceiling wall 11, the structural building panels 13 can also include a plurality of retaining members 45 extending between the second flanges 18*b* of the channels 14 approximately every 4 to 8 feet. In a preferred embodiment, each retaining member is generally T-shaped in cross section which is defined by a base portion 46 and a top portion 47. The retaining members are secured to the second flanges of the channels by suitable fasteners 48. In the embodiment shown in FIG. 8, a section of the base portion 46 having a length corresponding to the width of the second flanges 18*b* is removed from each end of the retaining member so that the top portion 47 of the retaining members can be positioned adjacent to the second flanges of the channels. To facilitate securing the retaining members to the second flanges, rectangular portions extending the length of the foam insulation members can be removed and later filled with a foam insulation insert after the retaining members have been secured to the second flanges of the channels. In an alternate embodiment shown in FIG. 10, the retaining member is inverted such that the top portion 47 of the retaining member overlays the second flanges of the channels without necessitating the removal of the ends of the base portion 46 of the retaining members. Preferably, grooves are precut in the foam insulation members to receive the retaining members.

Figure 9:
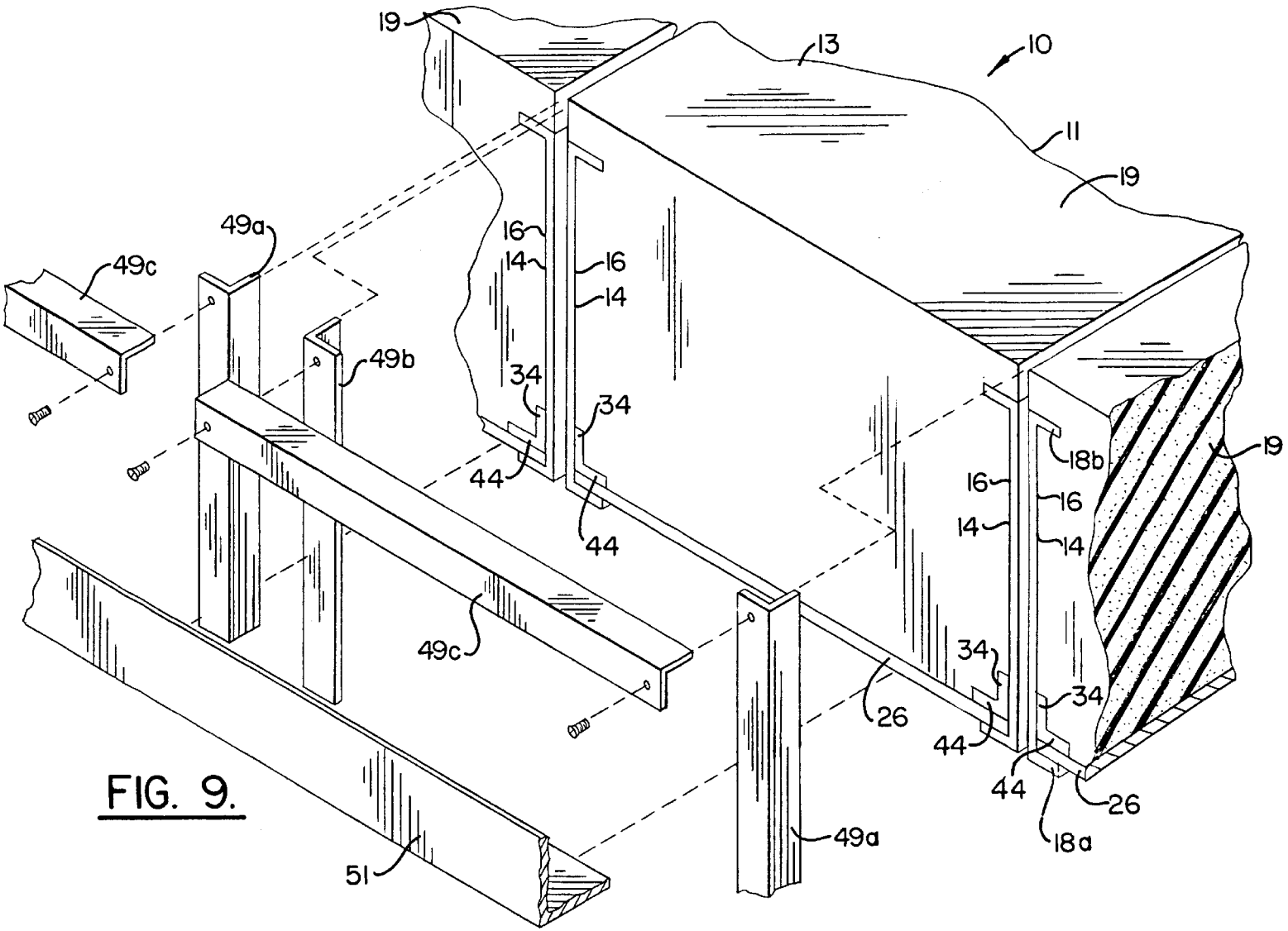
FIG. 9 is a partial exploded view illustrating an embodiment of the premanufactured structural building panel system according to the present invention as used to form a roof system.

As shown in FIG. 9, the structural building panels 13 can also include capping members 49 which have a generally L-shaped cross section. Two of the capping members are preferably positioned such that each capping member 49*a,b* extends between the first and second flanges 18*a,b* of a channel 14. A third capping member 49*c* is then positioned such that it extends between the ends of the first two capping members 49*a,b* adjacent to the second flanges of the channels. The capping members can be secured by suitable fasteners 50 or by tack welding. Preferably, the fire retarding board 26 and the first flanges of the channels are further capped by an L-channel 51, which is secured to abutting building panels after the panels are installed. The L-channels facilitate securing of a vertical sidewall 12 to the roof and ceiling wall 11.

The individual premanufactured structural building panels 13 of the present invention can advantageously be constructed inexpensively and efficiently off-site in a manufacturing facility for later transport to and installation at the construction site. Moreover, since each of the structural panels 13 are made to the same specifications when constructing a particular type of exterior wall member 10, the structural panels facilitate standardized construction. Installation of the individual structural building panels 13 involves arranging the panels such that the exterior portions 23*a* of the opposite lateral sides 20 of the foam insulation members 19 are generally in abutting contact with the corresponding exterior portions 23*a* of adjacent panels. Additionally, the panels 13 are arranged such that the laterally outer surfaces 17 of the web portions 16 of the channels 14 are generally in abutting contact with the corresponding laterally outer surface of the web portions 16 of adjacent channels. The adjacent web portions 16 are then preferably connected to each other by tack welding at predetermined intervals along the interface of the first flanges 18*a* of adjacent channels 14.

As shown in FIG. 2B and 3, a finishing board 30 can be attached using conventional fasteners to the first flanges 18*a* of the channels 14 to provide a generally smooth surface on the interior of the vertical sidewalls 12 and the underside of the roof and ceiling wall 11. The finishing board 30 can be gypsum board, the interior surface of which can be prepared to receive either paint or wallpaper. Advantageously, the first flange 18*a* of each channel 14 is exposed and thus the structural building panels 13 are ready to receive the finishing board 30 directly on the first flange 18*a* without furring materials. In an alternative embodiment, the finishing board 30 may be omitted because the underside of the structural building panels 13 provides a relatively flat surface which can be prepared to receive paint directly.

A weatherable covering 32 is provided on the exteriorly facing surface 33 of the foam insulation members 19. The composition of the weatherable covering 32 varies depending on whether the exterior wall member 10 being constructed is a roof and ceiling wall 11 or a vertical sidewall 12. FIG. 1 shows the weatherable covering 32 for a roof and ceiling wall 11 which can be made of an elastomeric roof coating placed directly on the exteriorly facing surface 33 of the foam insulation member 19. The elastomeric skin can be white in color to increase light reflection and decrease heat absorption from the sun. Advantageously, the weatherable covering 32 for a roof and ceiling wall 11 will not require a ballast as in conventional roof systems, which can increase labor cost for installation and repair. As shown in FIG. 3, in situations where the exterior wall member 10 being constructed is a vertical sidewall 12, the weatherable covering 32 may comprise brick, stucco and aluminum, vinyl or clapboard siding, or preferably, weatherable plaster with a color aggregate for aesthetic variations. According to another embodiment (not shown), the weatherable covering includes a bottom layer of liquidous insulating foam, which is allowed to cure, and a top layer of an acrylic coating.

Figure 4:
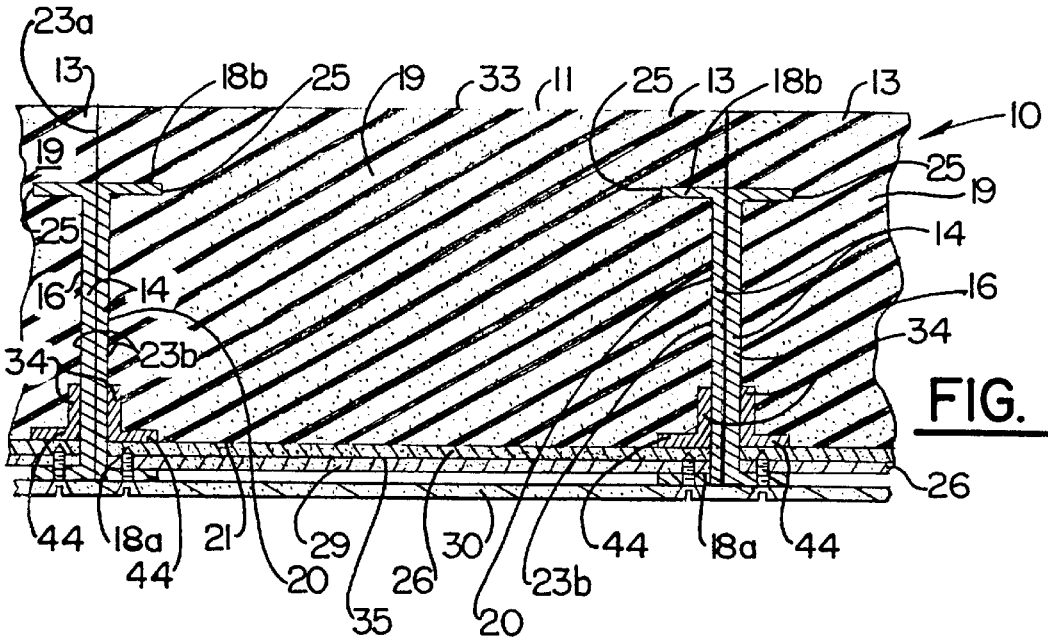
FIG. 4 is a plan view illustrating an alternate embodiment of a premanufactured structural building panel.

FIG. 4 shows an alternate embodiment of the premanufactured structural building panels in which a sound attenuating board 29 advantageously extends between the web portions 16 of the channels 14. The sound attenuating board 29 has a surface facing the interior of the building and an opposite exteriorly facing surface 35 which is preferably laminated to the fire retardant board 20. Preferably, the sound attenuating board 29 is a one inch thick panel of tectum fiber board.

Figure 12:
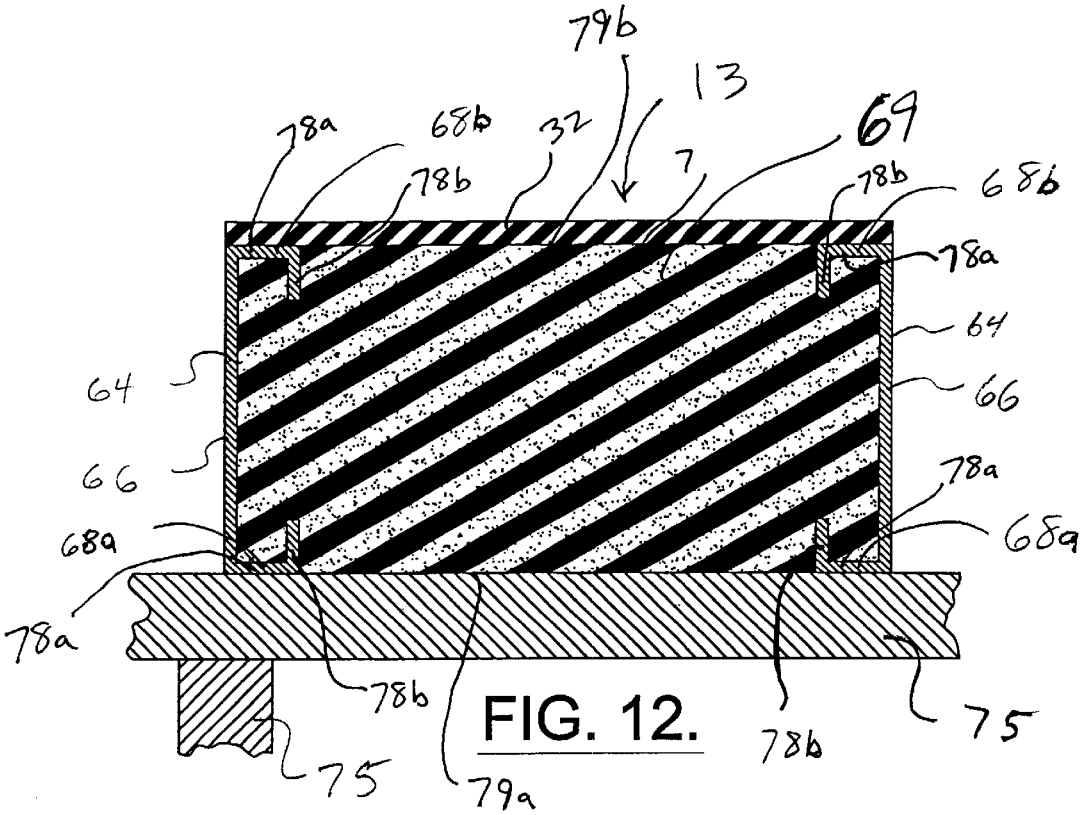
FIG. 12 is a partial cross section of a premanufactured structural building panel, according to another embodiment of the present invention.
Figure 13:
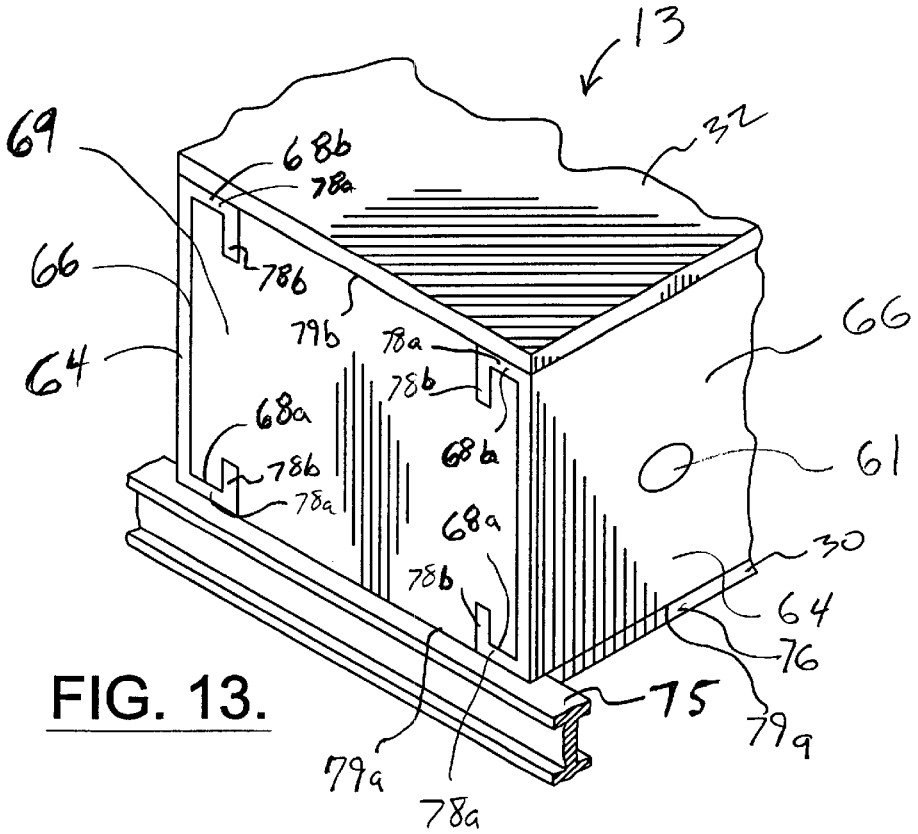
FIG. 13 is a partial perspective view illustrating the premanufactured structural building panel of FIG. 12.

FIGS. 12 and 13 illustrate another embodiment of a premanufactured structural building panel 13 of the present invention, as used to construct an exterior wall member 10, such as a horizontal roof and ceiling wall 11, as illustrated in FIG. 1, or a vertical side wall 12, as illustrated in FIG. 3. According to this embodiment, the panel 13 includes a pair of structural channels 64 extending longitudinally and being supported on a wall support member 75, as discussed above. Each of the channels 64 is of a generally C-shaped cross section which is defined by a web portion 66 having a laterally outer surface defining a plane and by first and second flanges 68*a, b* connected at opposite ends of the web portion 66. In one embodiment, as illustrated in FIG. 13, the web portion 66 of at least one of the channels 64 defines an aperture 61. The first and second flanges 68*a, b* each has first and second portions 78*a, b*. The first portion 78*a* of each flange 68*a, b* extends from the web portion 66 in a direction towards the other of the channels 64. The second portion 78*b* of each flange 68*a, b* of each channel 64 extends from the first portion 78*a* in a direction towards the other of the flanges 68*a, b* of the same channel 64.

The channels 64 are preferably steel channels. The specifications of the channels 64 are dependent upon the span between wall support members 75 and any specific loading requirements, including wind loads. The channels preferably range in height from 4 inches to 12 inches. In one embodiment, channels having a height of 10 inches and formed of 16 gauge steel are used as channels 64 in the construction of structural building panels 13 for horizontal spans of up to 30 feet. The channels 64 used in the construction of structural building panels 13 for installation as a vertical sidewall 12, as illustrated in FIG. 3, having a span of up to 25 feet between wall support members 15 are preferably 8 inch, 16 gauge steel channels. For residential housing, the channels can be 4 inch, 16 gauge steel channels.

For each premanufactured structural building panel 13, a foam insulation member 69 extends in part between the web portions 66 of the channels 64. The foam insulation member 69 may be formed of polyurethane, polystyrene, polypropylene, polyisocyanurate or polyethylene. The width and thickness of the foam insulation member 69 will vary depending upon the span between wall support members 75 and any specific loading or insulation requirements. In one embodiment, the foam insulation member 69 has a width of approximately 2 feet while the thickness of the foam insulation member 69 is varied depending on whether the exterior wall 10 to be constructed is a vertical sidewall 12 or a roof and ceiling wall 11. The thickness of a foam insulation member 69 in a structural building panel 13 for installation as a roof and ceiling wall 11, as shown in FIG. 1, will range from 4 to 12 inches and, preferably 8 to 12 inches, while the thickness of the foam insulation member 69 for a structural building panel 13 to be installed as a vertical sidewall 12, as shown in FIG. 3, will range from 4 to 12 inches and, preferably 7 to 8 inches. In either case, the foam insulation members 69 are lighter than conventional materials which can result in reduced labor costs in the construction of the premanufactured structural building panels 13 and later in the installation of the structural panels 13 to form an exterior wall 10.

Figure 16A:
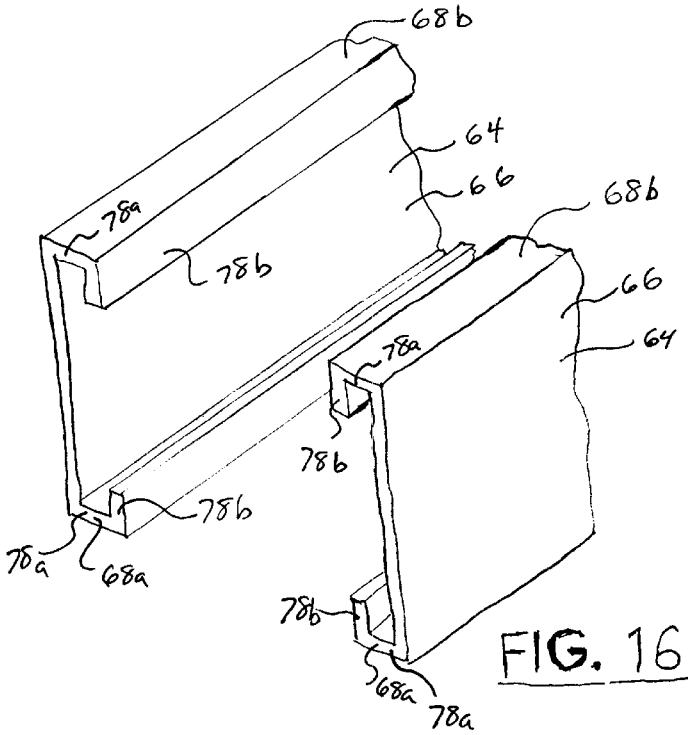
FIG. 16A is a partial perspective view illustrating the positioning of the structural channels of the building panel of FIG. 12 during the manufacture of the building panel.
Figure 16B:
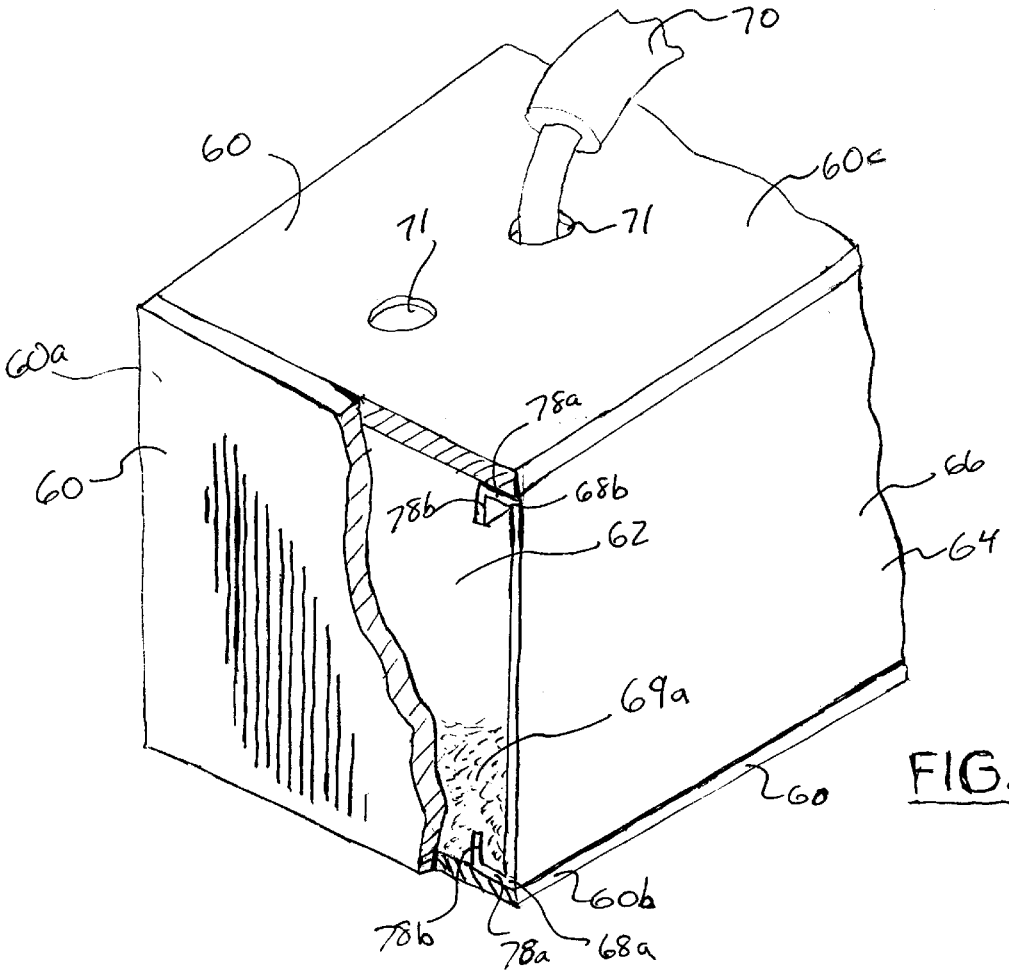
FIG. 16B is a partial perspective view illustrating the positioning of the forms adjacent the channels of FIG. 16A and the insertion of the insulating foam into the at least partially enclosed space defined by the forms and the channels.
Figure 16C:
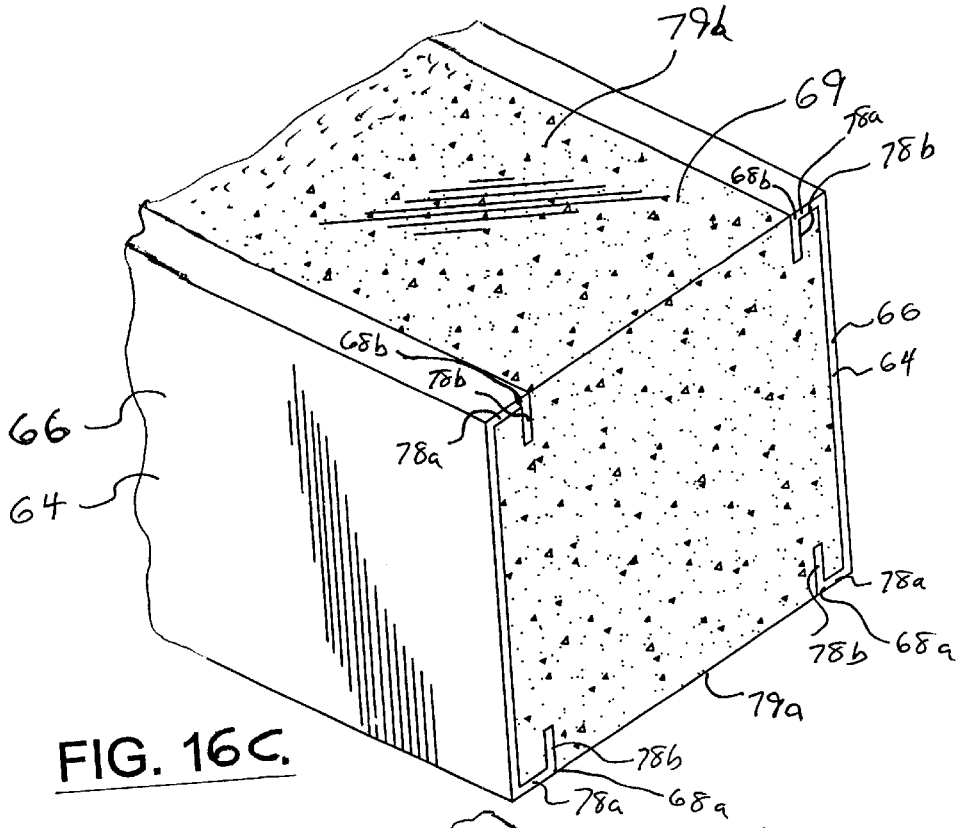
FIG. 16C is a partial perspective view illustrating the manufactured building panel of FIG. 16B.

Referring to FIGS. 16A, 16B, and 16C, there is illustrated a method of manufacturing a structural building panel 13, such as the panel shown in FIGS. 12 and 13, according to one embodiment of the present invention. As illustrated in FIG. 16A, a pair of longitudinally extending structural channels 64 are positioned adjacent to one another to define part of an at least partially enclosed space 62. As illustrated in FIG. 16B, at least one form 60 (hereinafter referred to collectively as "formwork") is positioned adjacent to the channels 64 to thereby define the at least partially enclosed space 62. The formwork 60 is preferable constructed of wood or another material that can be used repeatedly to manufacture multiple structural building panels 13 having the same shape and dimensions. According to the embodiment illustrated in FIG. 16B, a form 60*a* is positioned adjacent to the channels 64 at each end, a form 60*b* is positioned adjacent to the channels 64 such that the form 60*b* extends between the first flanges 68*a* of both channels and a form 60*c* is positioned adjacent to the channels 64 such that the form 60*c* extends between the second flanges 68*b* of both channels. The formwork 60 may be held in place using suitable fasteners.

A liquidous insulating foam 69*a* is inserted or injected into the at least partially enclosed space 62 defined by the formwork 60 and the channels 64. The insulating foam 69*a* can be pumped from a source (not shown) to a dispenser 70 using suitable piping, as is known in the art. In one embodiment, as illustrated in FIG. 16B, the insulating foam 69*a* is injected into the space defined by the formwork 60 and the channels 64 through an aperture 71 defined by one of the forms 60. Preferably, the form 60 defines a series of apertures 71 along the length of the channels 64 so that the entire space 62 defined by the formwork 60 and the channels 64 can be filled with the insulating foam 69*a*. In another embodiment (not shown), the inserting step can include injecting the insulating foam 69*a* through an aperture 61 or series of apertures defined by the web portion 66 of one of the channels 64. For example, a channel 64 having a web portion 66 that defines an aperture for injecting the insulating foam is illustrated in FIG. 13. Depending on the type of insulating foam utilized, the foam may expand to fill any voids within the space defined by the formwork 60 and the channels 64. The formwork 60 is then held in place adjacent the channels 64 until the insulating foam 69*a* has cured. Thereafter, the formwork 60 can be removed from the channels 64.

As illustrated in FIGS. 12, 13, and 16C, the foam insulation member 69 defines first and second oppositely facing surfaces 79*a, b*. The first facing surface 79*a* of the foam insulation member 69 corresponds to the first flanges 68*a* of the channels 64. The second facing surface 79*b* of the foam insulation member 69 corresponds to the second flanges 68*b* of the channels 64. Advantageously, the first and second oppositely facing surfaces 79*a, b* are each adapted to engage the corresponding first and second flanges 68*a, b* to thereby secure the channels 64 to the foam insulation member 69. More specifically, the first and second flanges 68*a, b* are anchored within the corresponding facing surfaces 79*a, b* of the foam insulation member 69 as the insulating foam 69*a* cures around the second portions 78*b* of the first and second flanges 68*a, b*. As discussed above, the foam insulation members 69 also decrease the amount of convective heat transfer compared to conventional insulation, and thus, provide improved insulation properties.

Advantageously, as illustrated in FIG. 13, the first portion 78*a* of the first and second flanges 68*a, b* are generally coplanar with the corresponding facing surfaces 79*a, b* of the foam insulation member 64 to thereby provide substantially planar surfaces along both of the lateral sides of each of the premanufactured structural building panels 13 which provides a consistent interface along the length of adjacent structural building panels when the structural panels are installed in a side-by-side relationship. According to one embodiment, as shown in FIG. 13, a finishing board 30, such as drywall, or a fire retarding board 76, such as a ½ to one-inch thick panel of gypsum coreboard can be secured to the first portions 78*a* of at least one of the first flanges 68*a* of the channels 64 using suitable fasteners. As discussed above, a weatherable covering 32 may be provided on the exteriorly facing surface of the foam insulation member 69 and second flanges 68*b*.

Figure 14:
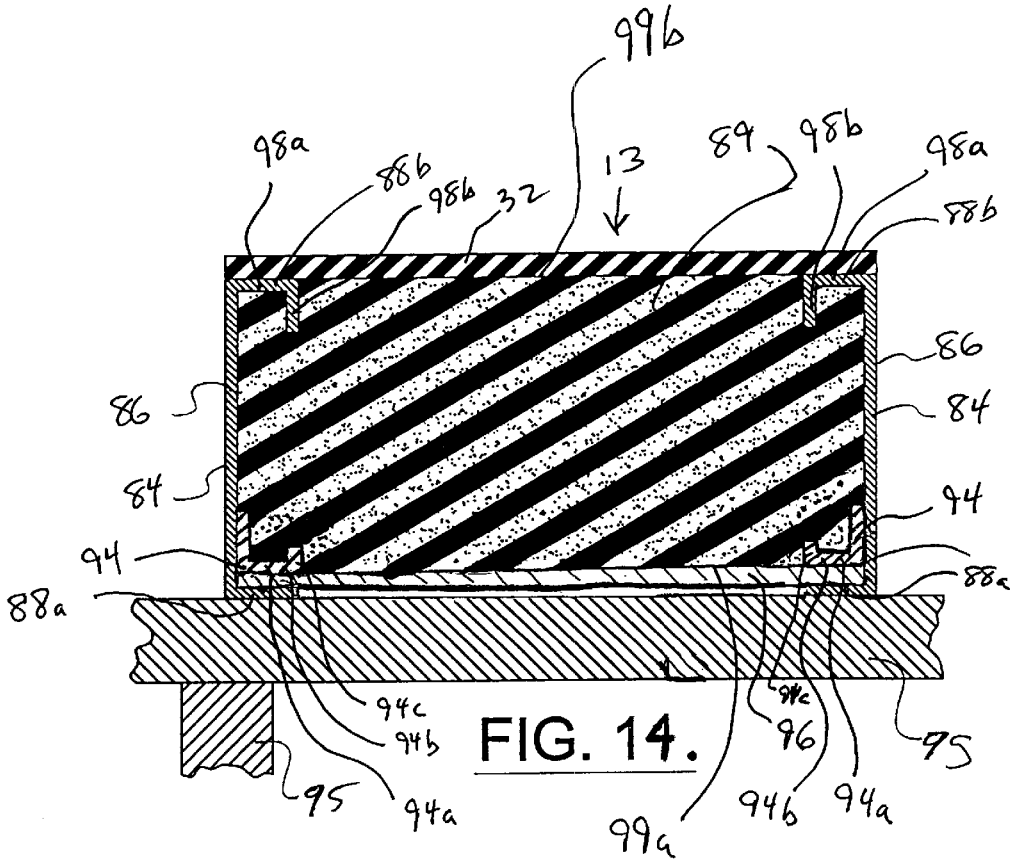
FIG. 14 is a partial cross section of a premanufactured structural building panel, according to another embodiment of the present invention.
Figure 15:
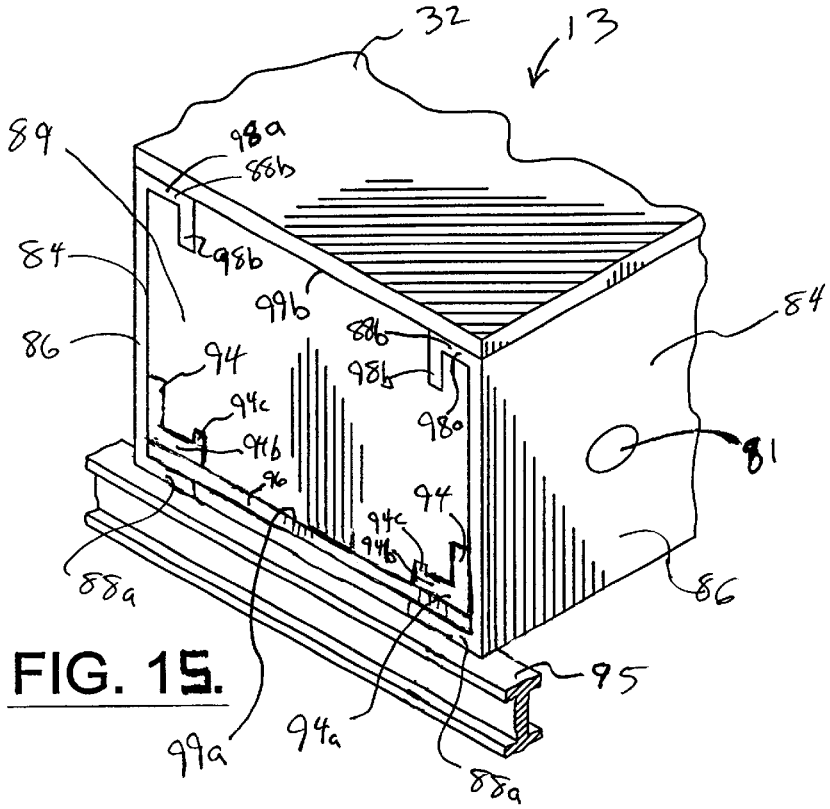
FIG. 15 is a partial perspective view illustrating the premanufactured structural building panel of FIG. 14.

FIGS. 14 and 15 illustrate another embodiment of a premanufactured structural building panel 13 of the present invention, as used to construct an exterior wall member 10, such as a horizontal roof and ceiling wall 11, as illustrated in FIG. 1, or a vertical side wall 12, as illustrated in FIG. 3. According to this embodiment, the panel 13 includes a pair of structural channels 84 extending longitudinally and being supported on a wall support member 95, as discussed above. Each of the channels 84 is of a generally C-shaped cross section which is defined by a web portion 86 having a laterally outer surface defining a plane and by first and second flanges 88*a, b* connected at opposite ends of the web portion 86. In one embodiment, as illustrated in FIG. 15, the web portion 86 of at least one of the channels 84 defines an aperture 81. The first flanges 88*a* extend from the respective web portion 86 in a direction towards the other of the channels 84. The second flanges 88*b* have first and second portions 98*a, b*. The first portion 98*a* of each second flange 88*b* extends from the web portion 86 in a direction towards the other of the channels 84. The second portion 98*b* of each second flange 88*b* of each channel 84 extends from the first portion 98*a* in a direction towards the first flange 88*a* of the same channel 84.

The channels 84 are preferably steel channels. The specifications of the channels 84 are dependent upon the span between wall support members 95 and any specific loading requirements, including wind loads. The channels preferably range in height from 4 inches to 12 inches. In one embodiment, channels having a height of 10 inches and formed of 16 gauge steel are used as channels 84 in the construction of structural building panels 13 for horizontal spans of up to 30 feet. The channels 84 used in the construction of structural building panels 13 for installation as a vertical sidewall 12, as illustrated in FIG. 3, having a span of up to 25 feet between wall support members 15 are preferably 8 inch, 16 gauge steel channels. For residential housing, the channels can be 4 inch, 16 gauge steel channels.

Figure 17C:
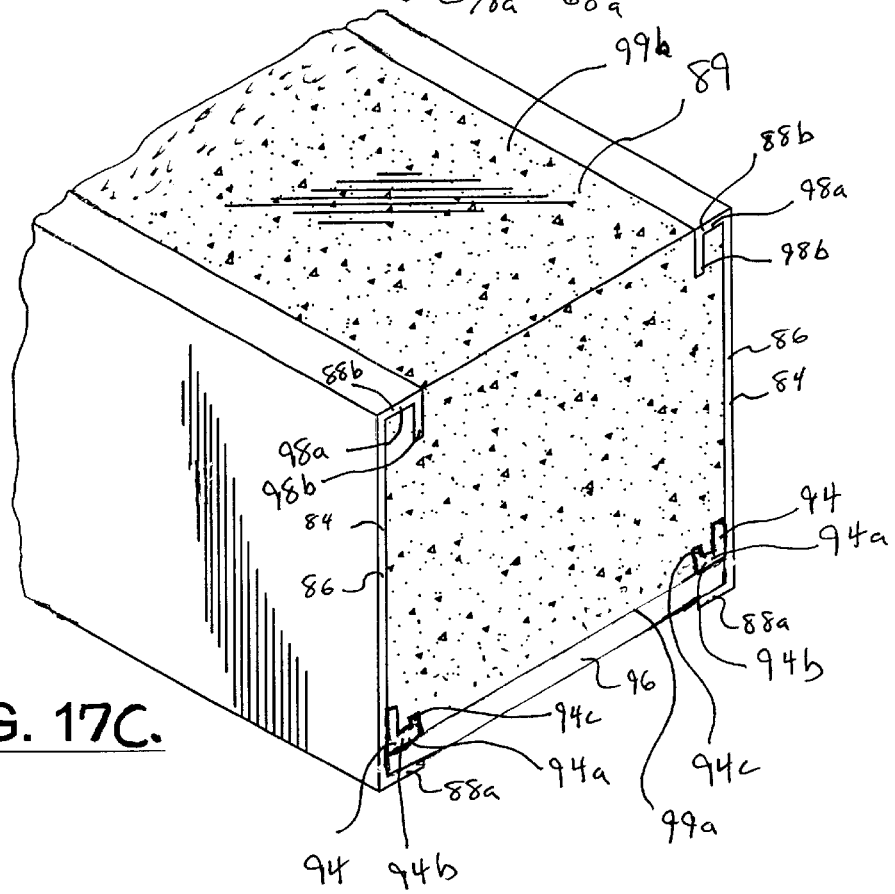
FIG. 17C is a partial perspective view illustrating the manufactured building panel of FIG. 17B.
Figure 17A:
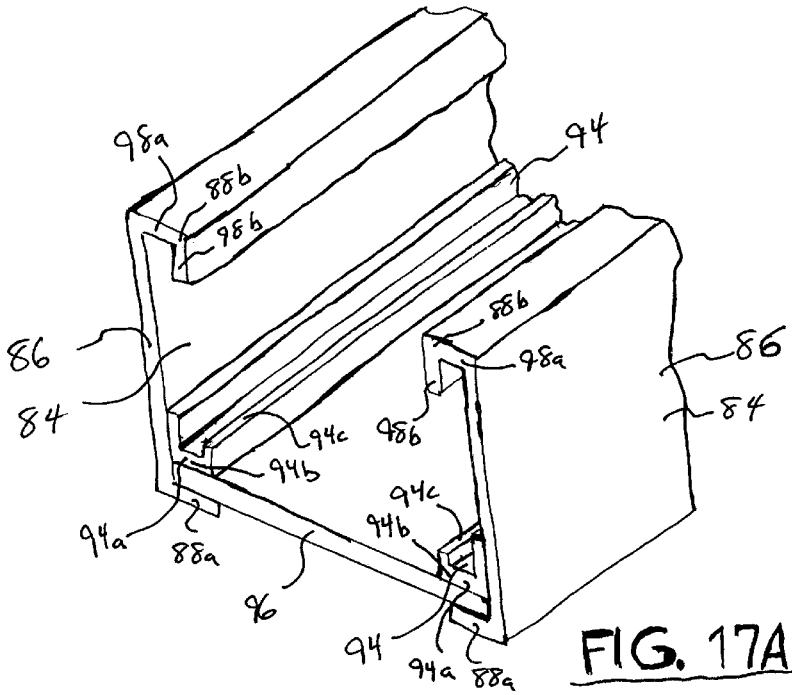
FIG. 17A is a partial perspective view illustrating the positioning of the structural channels, fire retarding board and third flanges of the building panel of FIG. 14 during the manufacture of the building panel.

As illustrated in FIGS. 15 and 17A, a pair of angle members 94 having a generally L-shaped cross section defined by two perpendicular arm portions provide third flanges 94a extending from the web portions 86 of each of the channels 84 in a direction towards the other channel. The angle members 94 are preferably formed of steel. The angle members are located between the first and second flanges 88*a,b* and are connected to the web portions 86 of the channels 84 using conventional welding techniques or suitable fasteners. In one embodiment, the angle members 94 are 1.5 inch by 1.5 inch conventional angle iron, such as the angle members 34 shown in FIG. 1, which will provide additional structural strength to the channels 84. In another embodiment, as illustrated in FIG. 14 and 17A, the third flanges 94*a* of the angle members 94 include first and second portions 94*b, c*. The first portion 98*b* of each third flange 94*a* extends from the web portion 86 in a direction towards the other channel. The second portion 94*c* of each of third flange 94*a* extends from the first portion 94*b* in a direction towards the second flange 88*b* of the same channel 84. The second portion 94*c* defines a lip or raised portion that is preferably ½ to 1 inches in height.

As shown in FIGS. 14 and 15, each panel 13 includes at least one fire retarding board 96 having lateral side edges extending between the web portions 86 of the channels 84 adjacent the first flanges 88*a* of the channels such that the lateral side edges are engaged between the first and third flanges. The fire retarding board 96 has a surface facing the interior of the building and an opposite exteriorly facing surface. The third flanges 94*a* are secured to the exteriorly facing surface of the fire retarding board by adhesive or suitable fasteners. In one embodiment, the fire retarding board 96 is a ½ to one-inch thick panel of gypsum coreboard, but the thickness of the fire retarding board can vary depending on the required fire rating.

For each premanufactured structural building panel 13, a foam insulation member 89 extends in part between the web portions 86 of the channels 84. The foam insulation member 89 may be formed of polyurethane, polystyrene, 30 polypropylene, polyisocyanurate or polyethylene. The width and thickness of the foam insulation member 89 will vary depending upon the span between wall support members 95 and any specific loading or insulation requirements. In a one embodiment, the foam insulation member 89 has a width of approximately 2 feet while the thickness of the foam insulation member 89 is varied depending on whether the exterior wall 10 to be constructed is a vertical sidewall 12 or a roof and ceiling wall 11. The thickness of a foam insulation member 89 in a structural building panel 13 for installation as a roof and ceiling wall 11, as shown in FIG. 1, will range from 4 to 12 inches and, preferably 8 to 12 inches, while the thickness of the foam insulation member 89 for a structural building panel 13 to be installed as a vertical sidewall 12, as shown in FIG. 3, will range from 4 to 12 inches and, preferably 7 to 8 inches. In either case, the foam insulation members 89 are lighter than conventional materials which can result in reduced labor costs in the construction of the premanufactured structural building panels 13 and later in the installation of the structural panels 13 to form an exterior wall 10.

Figure 17B:
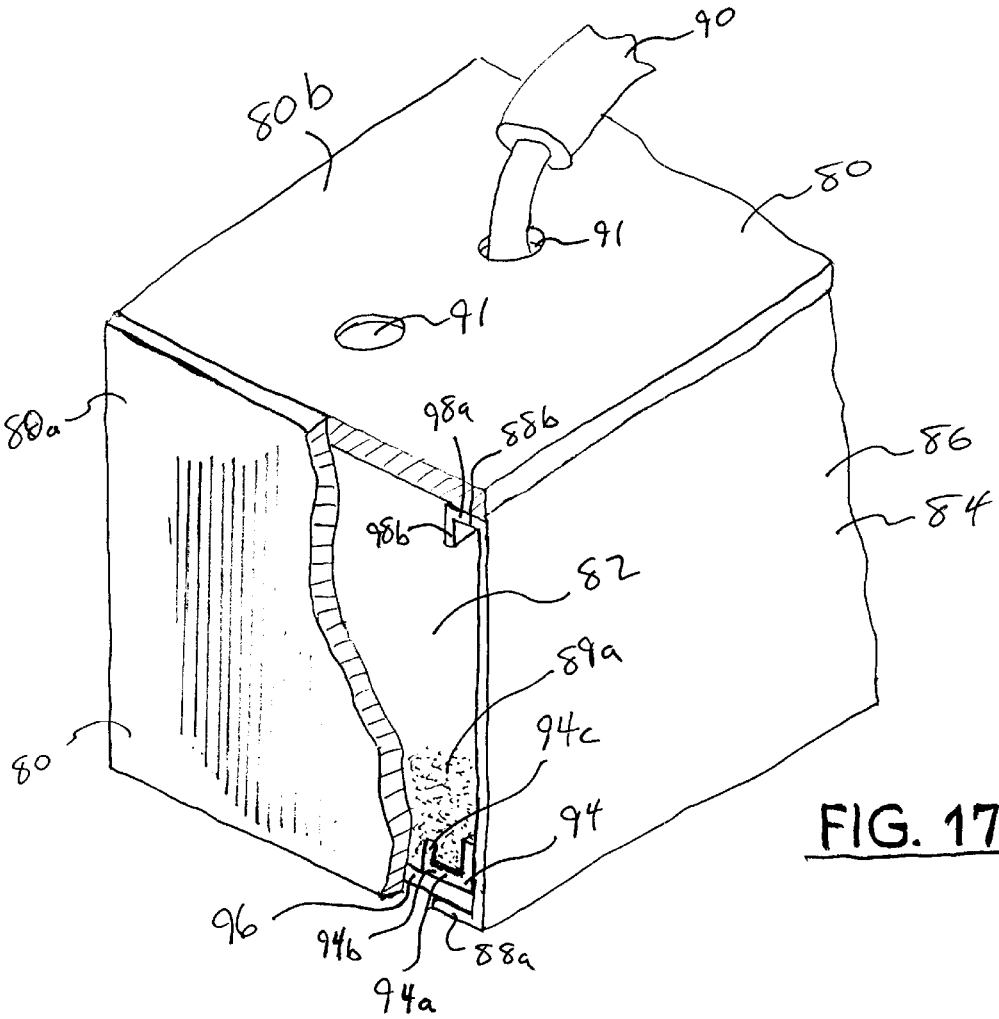
FIG. 17B is a partial perspective view illustrating the positioning of the forms adjacent the channels of FIG. 17A and the insertion of the insulating foam into the at least partially enclosed space defined by the forms and the channels.

Referring to FIGS. 17A, 17B, and 17C, there is illustrated a method of manufacturing a structural building panel 13, such as the panel shown in FIGS. 14 and 15, according to one embodiment of the present invention. As illustrated in FIG. 17A, a pair of longitudinally extending structural channels 84 are positioned adjacent to one another. A pair of longitudinally extending angle members 94 are secured along opposite edges of the first side of a fire retarding board 96. The fire retarding board 96 and angle members 94 are placed between the pair of longitudinally extending structural channels 84 such that the fire retarding board extends between the channels to thereby define part of an at least partially enclosed space 82. As illustrated in FIG. 17B, at least one form 80 (hereinafter referred to collectively as "formwork") is positioned adjacent to the channels 84 to thereby define the at least partially enclosed space 82. As discussed above, the formwork 80 is preferable constructed of wood or another material that can be used repeatedly to manufacture multiple structural building panels 13 having the same shape and dimensions. According to the embodiment illustrated in FIG. 17B, a form 80*a* is positioned adjacent to the channels 84 at each end and a form 80*b* is positioned adjacent to the channels 84 such that the form 80*a* extends between the second flanges 88*b* of both channels. The formwork 80 may be held in place using suitable fasteners.

A liquidous insulating foam 89*a* is inserted or injected into the at least partially enclosed space 82 defined by the formwork 80 and the channels 84. The insulating foam 89*a* can be pumped from a source (not shown) to a dispenser 90 using suitable piping, as is known in the art. In one embodiment, as illustrated in FIG. 17B, the insulating foam 89*a* is injected into the space defined by the formwork 80 and the channels 84 through an aperture 91 defined by one of the forms 80. Preferably, the form 80 defines a series of apertures 91 along the length of the channels 84 so that the entire space 82 defined by the formwork 80 and the channels 84 can be filled with the insulating foam 89*a*. In another embodiment (not shown), the inserting step can include injecting the insulating foam 89*a* through an aperture or series of apertures defined by the web portion 86 of one of the channels 84. For example, a channel 84 having a web portion 86 that defines an aperture 81 for injecting the insulating foam is illustrated in FIG. 15. Depending on the type of insulating foam utilized, the foam may expand to fill any voids within the space defined by the formwork 80 and the channels 84. The formwork 80 is then held in place adjacent the channels 84 until the insulating foam 89*a* has cured. Thereafter, the formwork 80 can be removed from the channels 84.

As illustrated in FIGS. 14, 15, and 17C, the foam insulation member 89 defines first and second oppositely facing surfaces 99*a, b*. The first facing surface 99*a* of the foam insulation member 89 corresponds to the third flanges 94*a* and the fire retarding board 96. The second facing surface 99*b* of the foam insulation member 89 corresponds to the second flanges 88*b* of the channels 84. Advantageously, the second facing surface 99*b* is adapted to engage the second flanges 88*b* to thereby secure the channels 84 to the foam insulation member 89. More specifically, the second flanges 88*b* are anchored within the second facing surface 99*b* of the foam insulation member 89 as the insulating foam 99*a* cures around the second portions 98*b* of the second flanges 88*b*. For embodiments of the structural building panel 13 that utilize the third flanges 94*a* illustrated in FIG. 1, the first facing surface 99*a* is in intimate contact with the third flanges 94*a* and, thus, at least partially anchors the third flange within the panel. For additional structural strength, the third flange 94*a* illustrated in FIGS, 14, 15, and 17C can be utilized. In this embodiment, as illustrated in FIGS. 17B and 17C, the first facing surface 99*a* is adapted to engage the third flanges 94*a* to thereby further secure the channels 84 to the foam insulation member 89. More specifically, the third flanges 94*a* are anchored within the corresponding first facing surface 99*a, b* of the foam insulation member 89 as the insulating foam 99*a* cures around the second portions 94*c* of the third flanges 94*a*. As discussed above, the foam insulation members 89 decrease the amount of convective heat transfer compared to conventional insulation, and thus, provide improved insulation properties.

Advantageously, as illustrated in FIG. 14, the first portions 98*a* of the second flanges 88*b* are generally coplanar with the second facing surface 99*b* of the foam insulation member 84 to thereby provide a substantially planar surface along the lateral sides of the premanufactured structural building panels 13 which provides a consistent interface along the length of adjacent structural building panels when the structural panels are installed in a side-by-side relationship. As discussed above, a weatherable covering 32 may be provided on the exteriorly facing surface of the foam insulation member 89 and the second flanges 88*b*. Similarly, the first flanges 88*a* are generally coplanar with the fire retarding board 96 to thereby provide a substantially planar surface along the lateral sides of the premanufactured structural building panels 13. If a more finished surface is desired, a finishing board 30 can be secured to the first flanges 88*a* using suitable fasteners.

Figure 18:
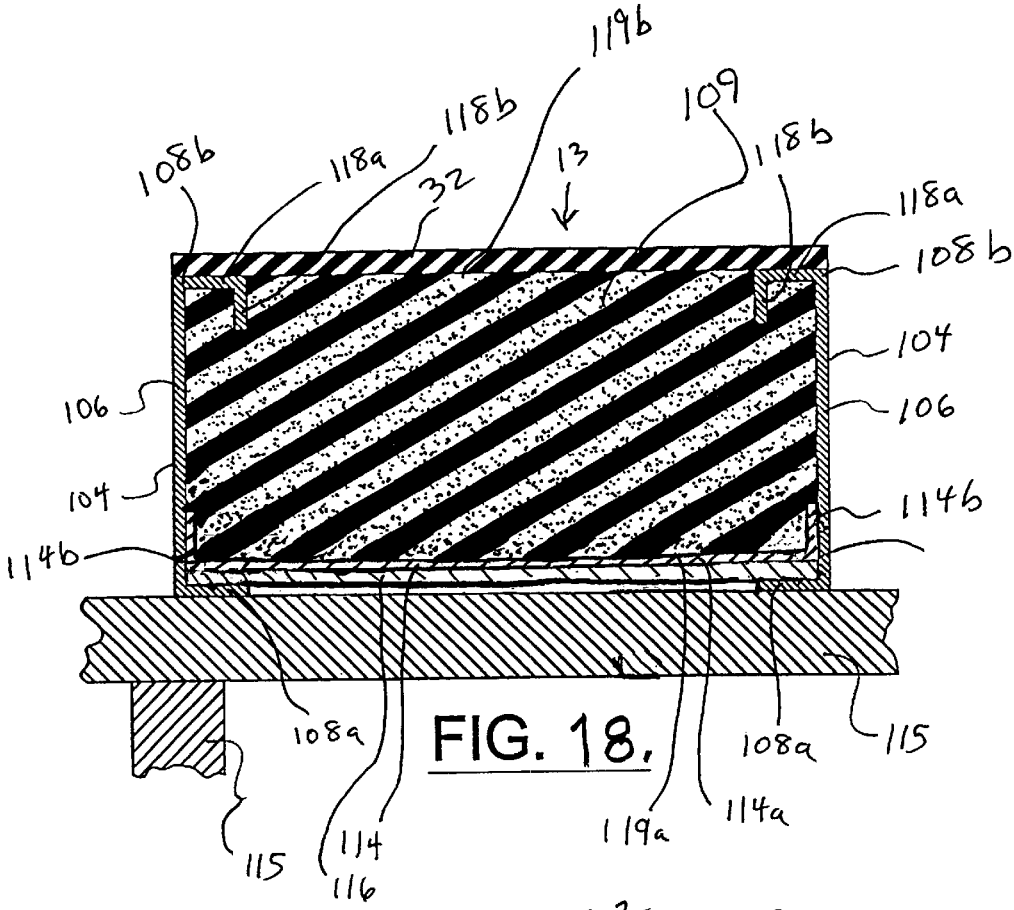
FIG. 18 is a partial cross section of a premanufactured structural building panel, according to another embodiment of the present invention.
Figure 19:
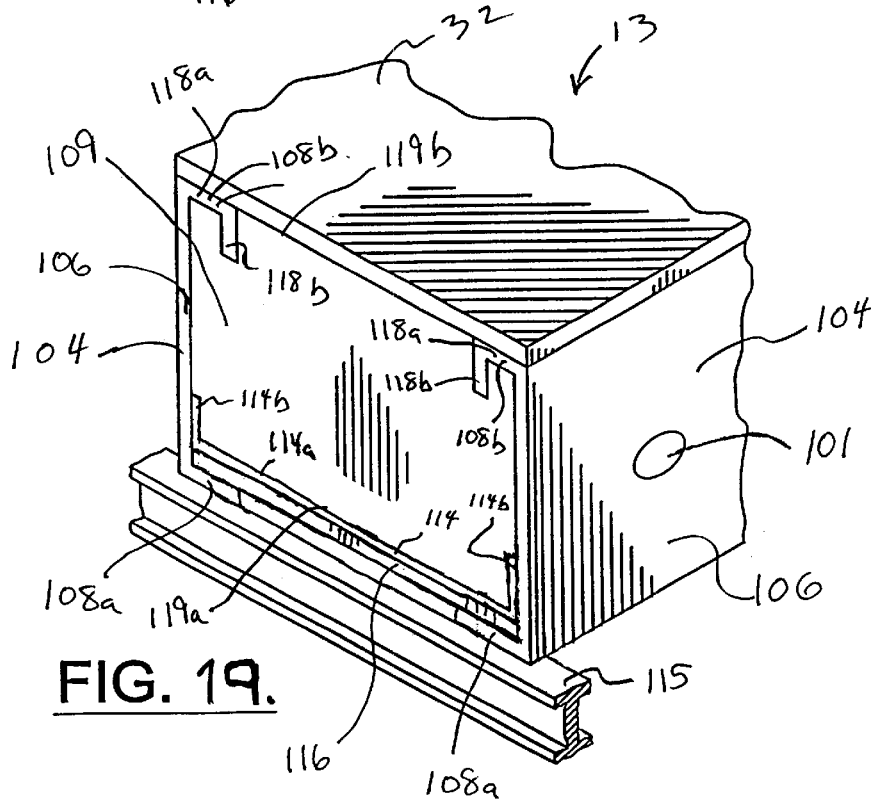
FIG. 19 is a partial perspective view illustrating the premanufactured structural building panel of FIG. 18.

FIGS. 18 and 19 illustrate another embodiment of a premanufactured structural building panel 13 of the present invention, as used to construct an exterior wall member 10, such as a horizontal roof and ceiling wall 11, as illustrated in FIG. 1, or a vertical side wall 12, as illustrated in FIG. 3. According to this embodiment, the panel 13 includes a pair of structural channels 104 extending longitudinally and being supported on a wall support member 115, as discussed above. Each of the channels 104 is of a generally C-shaped cross section which is defined by a web portion 106 having a laterally outer surface defining a plane and by first and second flanges 108*a, b* connected at opposite ends of the web portion 106. In one embodiment, as illustrated in FIG. 19, the web portion 106 of at least one of the channels 104 defines an aperture 101. The first flanges 108*a* extend from the respective web portion 106 in a direction towards the other of the channels 104. The second flanges 108*b* have first and second portions 118*a, b*. The first portion 118*a* of each second flange 108*b* extends from the web portion 106 in a direction towards the other of the channels 104. The second portion 118*b* of each second flange 108*b* of each channel 104 extends from the first portion 118*a* in a direction towards the first flange 108*a* of the same channel 104.

The channels 104 are preferably steel channels. The specifications of the channels 104 are dependent upon the span between wall support members 115 and any specific loading requirements, including wind loads. The channels preferably range in height from 4 inches to 12 inches. In one embodiment, channels having a height of 10 inches and formed of 16 gauge steel are used as channels 104 in the construction of structural building panels 13 for horizontal spans of up to 30 feet. The channels 104 used in the construction of structural building panels 13 for installation as a vertical sidewall 12, as illustrated in FIG. 3, having a span of up to 25 feet between wall support members 15 are preferably 8 inch, 16 gauge steel channels. For residential housing, the channels can be 4 inch, 16 gauge steel channels.

Figure 20A:
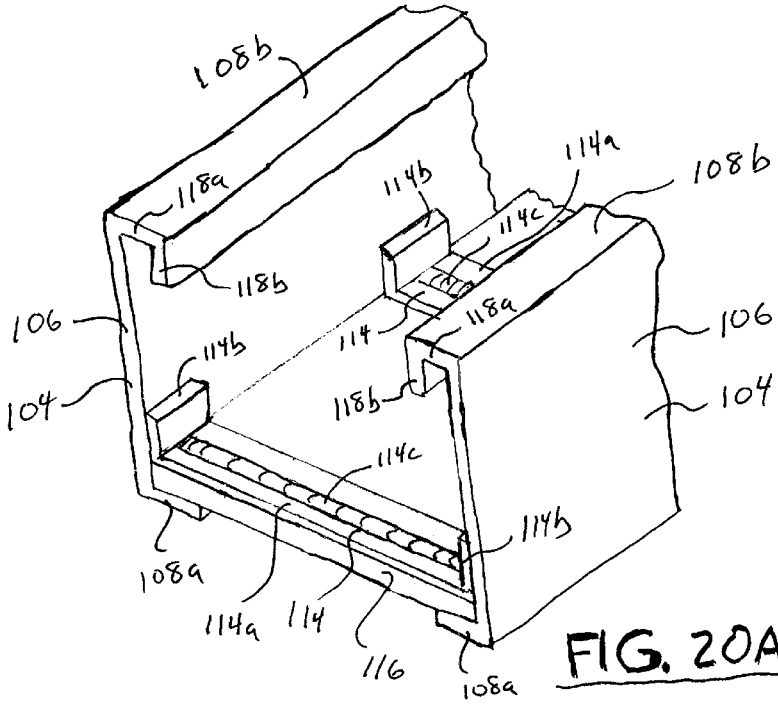
FIG. 20A is a partial perspective view illustrating the positioning of the structural channels, fire retarding board and retaining members of the building panel of FIG. 18 during the manufacture of the building panel.
Figure 21A:
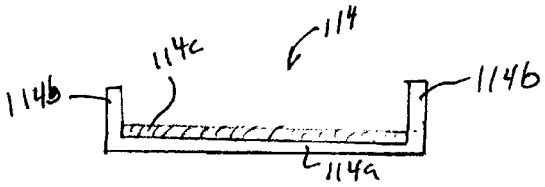
FIG. 21A is a side plan view of the retaining member of FIG. 20A.
Figure 21B:
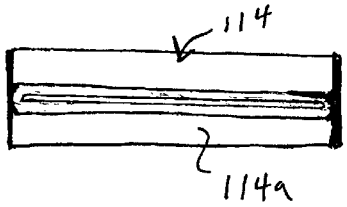
FIG. 21B is a bottom plan view of the retaining member of FIG. 21A.

As illustrated in FIGS. 19 and 20A, each structural building panel 13 includes at least one retaining member 114 and, preferably a plurality of retaining members, having a generally C-shaped cross section which is defined by a web portion 114*a* having a laterally outer surface defining a plane and by first and second flanges 114*b* connected at opposite ends of the web portion 114*a*. The retaining members 114 are preferably formed of steel. In one embodiment, as illustrated in FIGS. 21A and 21B, the retaining members 114 include a raised portion 114*c* which provides structural reinforcement. The retaining members 114 are located between the first and second flanges 108*a,b* and can be connected to the web portions 106 of the channels 104 using conventional welding techniques or suitable fasteners.

As shown in FIGS. 18 and 19, each panel 13 includes at least one fire retarding board 116 having lateral side edges extending between the web portions 106 of the channels 104 adjacent the first flanges 108*a* of the channels such that the lateral side edges are engaged between the first and third flanges. The fire retarding board 116 has a surface facing the interior of the building and an opposite exteriorly facing surface. The retaining members 114 are secured to the exteriorly facing surface of the fire retarding board 116 by adhesive or suitable fasteners. The spacing of between the retaining members 114 varies depending upon the span between wall support members 115 and any specific loading requirements of the panels 13. In one embodiment, the retaining members are spaced 4 feet on center. In another embodiment, the fire retarding board 116 is a ½ to one-inch thick panel of gypsum coreboard, but the thickness of the fire retarding board can vary depending on the required fire rating.

For each premanufactured structural building panel 13, a foam insulation member 109 extends in part between the web portions 106 of the channels 104. The foam insulation member 109 may be formed of polyurethane, polystyrene, polypropylene, polyisocyanurate or polyethylene. The width and thickness of the foam insulation member 109 will vary depending upon the span between wall support members 115 and any specific loading or insulation requirements. In a one embodiment, the foam insulation member 109 has a width of approximately 2 feet while the thickness of the foam insulation member 109 is varied depending on whether the exterior wall 10 to be constructed is a vertical sidewall 12 or a roof and ceiling wall 11. The thickness of a foam insulation member 109 in a structural building panel 13 for installation as a roof and ceiling wall 11, as shown in FIG. 1, will range from 4 to 12 inches and, preferably 8 to 12 inches, while the thickness of the foam insulation member 109 for a structural building panel 13 to be installed as a vertical sidewall 12, as shown in FIG. 3, will range from 4 to 12 inches and, preferably 7 to 8 inches. In either case, the foam insulation members 109 are lighter than conventional materials which can result in reduced labor costs in the construction of the premanufactured structural building panels 13 and later in the installation of the structural panels 13 to form an exterior wall 10.

Figure 20B:
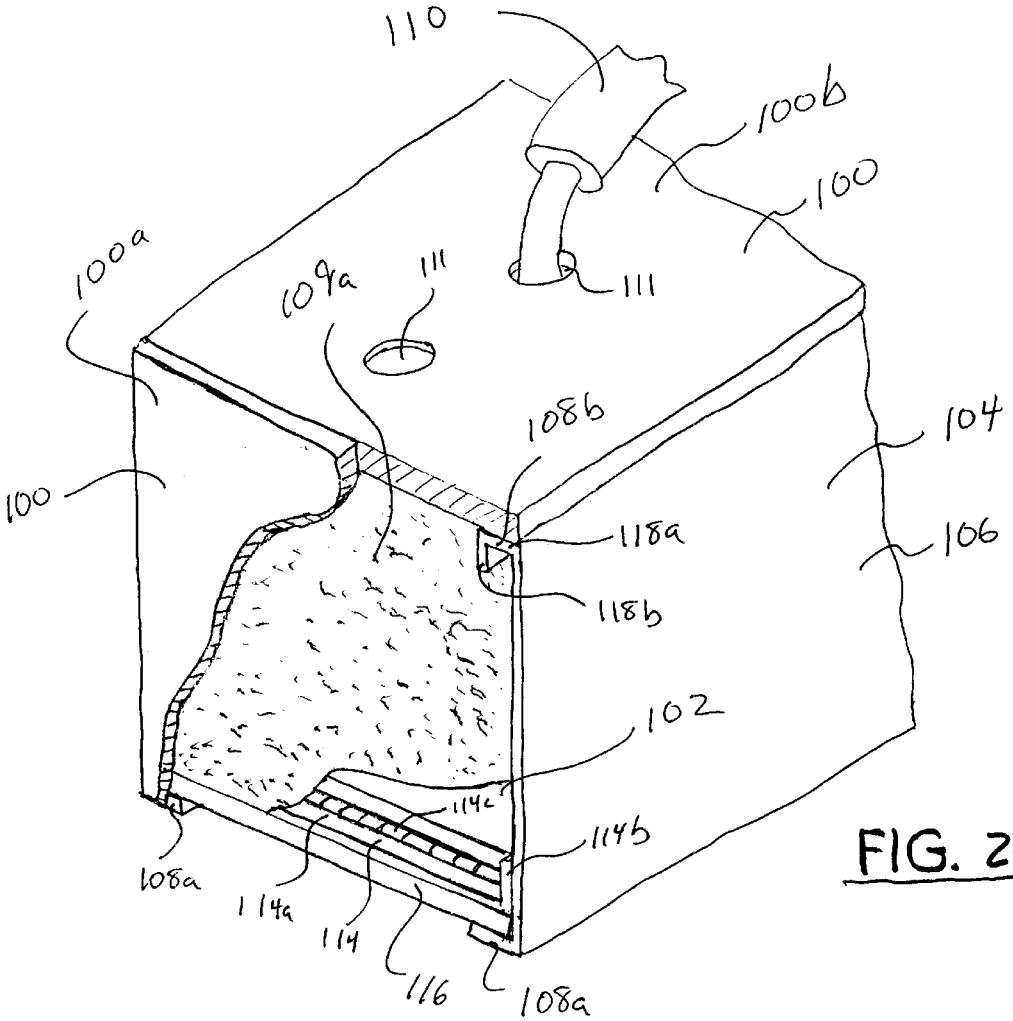
FIG. 20B is a partial perspective view illustrating the positioning of the forms adjacent the channels of FIG. 20A and the insertion of the insulating foam into the at least partially enclosed space defined by the forms and the channels.
Figure 20C:
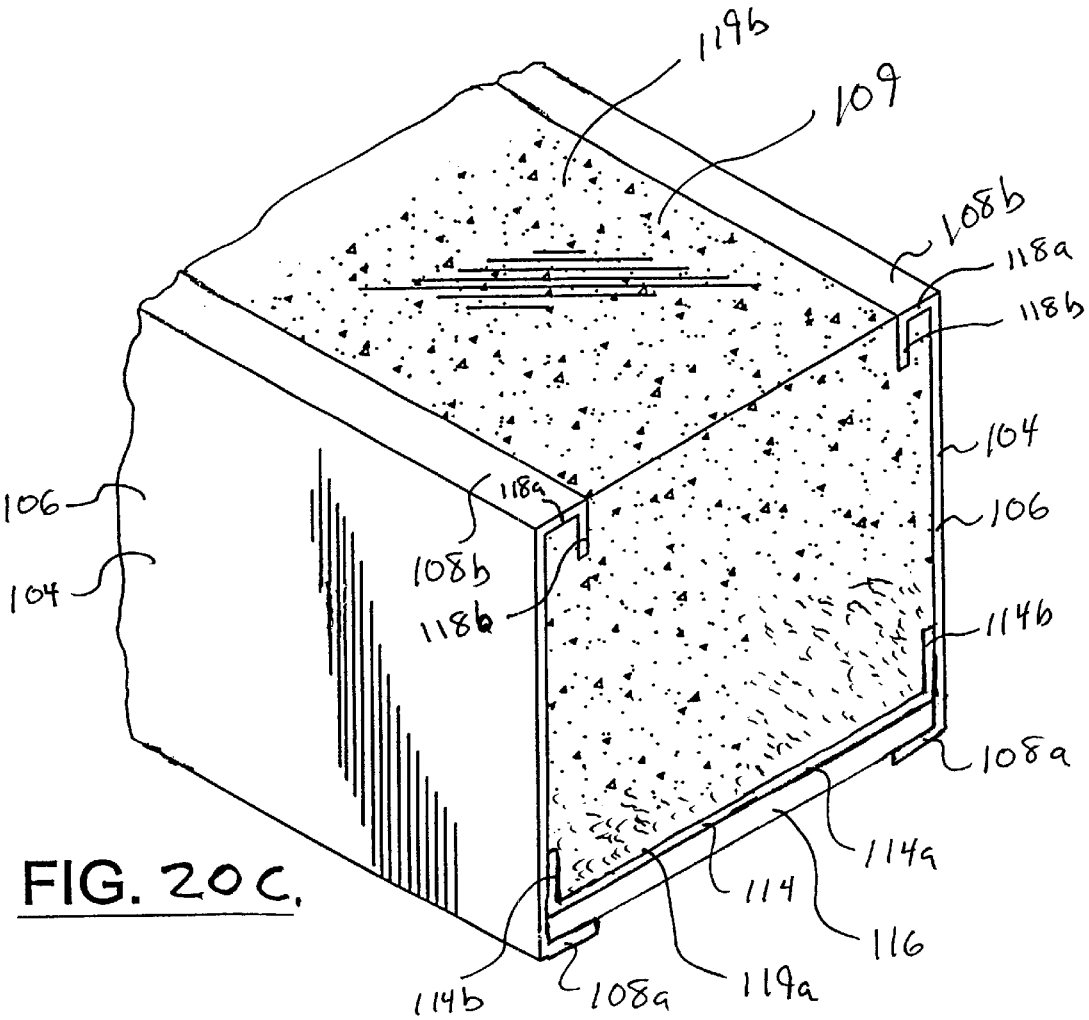
FIG. 20C is a partial perspective view illustrating the manufactured building panel of FIG. 20B.

Referring to FIGS. 20A, 20B, and 20C, there is illustrated a method of manufacturing a structural building panel 13, such as the panel shown in FIGS. 18 and 19, according to one embodiment of the present invention. As illustrated in FIG. 20A, a pair of longitudinally extending structural channels 104 are positioned adjacent to one another. At least one retaining member 114 and, preferably, a plurality of retaining members, are secured along the exteriorly facing surface of a fire retarding board 116. The fire retarding board 116 and retaining members 114 are placed between the pair of longitudinally extending structural channels 104 such that the fire retarding board and retaining members extend between the channels to thereby define part of an at least partially enclosed space 102. As illustrated in FIG. 20B, at least one form 100 (hereinafter referred to collectively as "formwork") is positioned adjacent to the channels 104 to thereby define the at least partially enclosed space 102. As discussed above, the formwork 100 is preferable constructed of wood or another material that can be used repeatedly to manufacture multiple structural building panels 13 having the same shape and dimensions. According to the embodiment illustrated in FIG. 20B, a form 100*a* is positioned adjacent to the channels 104 at each end and a form 100*b* is positioned adjacent to the channels 104 such that the form 80*a* extends between the second flanges 108*b* of both channels. The formwork 80 may be held in place using suitable fasteners.

A liquidous insulating foam 109*a* is inserted or injected into the at least partially enclosed space 102 defined by the formwork 100 and the channels 104. The insulating foam 109*a* can be pumped from a source (not shown) to a dispenser 110 using suitable piping, as is known in the art. In one embodiment, as illustrated in FIG. 20B, the insulating foam 109*a* is injected into the space defined by the formwork 100 and the channels 104 through an aperture 111 defined by one of the forms 100. Preferably, the form 100 defines a series of apertures 111 along the length of the channels 104 so that the entire space 102 defined by the formwork 100 and the channels 104 can be filled with the insulating foam 109*a*. In another embodiment (not shown), the inserting step can include injecting the insulating foam 109*a* through an aperture or series of apertures defined by the web portion 106 of one of the channels 104. For example, a channel 104 having a web portion 106 that defines an aperture 101 for injecting the insulating foam is illustrated in FIG. 15. Depending on the type of insulating foam utilized, the foam may expand to fill any voids within the space defined by the formwork 100 and the channels 104. The formwork 100 is then held in place adjacent the channels 104 until the insulating foam 109*a* has cured. Thereafter, the formwork 100 can be removed from the channels 104.

As illustrated in FIGS. 18, 19, and 20C, the foam insulation member 109 defines first and second oppositely facing surfaces 119*a, b*. The first facing surface 119*a* of the foam insulation member 109 corresponds to the at least one retaining member 114 and the fire retarding board 116. The second facing surface 119*b* of the foam insulation member 109 corresponds to the second flanges 108*b* of the channels 104. Advantageously, the second facing surface 119*b* is adapted to engage the second flanges 108*b* to thereby secure the channels 104 to the foam insulation member 109. More specifically, the second flanges 108*b* are anchored within the second facing surface 119*b* of the foam insulation member 109 as the insulating foam 119*a* cures around the second portions 118*b* of the second flanges 108*b*. The first facing surface 119*a* is in intimate contact with the at least one retaining member 114 and, thus, at least partially anchors the at least retaining member within the panel 13. As discussed above, the foam insulation members 109 decrease the amount of convective heat transfer compared to conventional insulation, and thus, provide improved insulation properties.

Advantageously, as illustrated in FIG. 18, the first portions 118*a* of the second flanges 108*b* are generally coplanar with the second facing surface 119*b* of the foam insulation member 104 to thereby provide a substantially planar surface along the lateral sides of the premanufactured structural building panels 13 which provides a consistent interface along the length of adjacent structural building panels when the structural panels are installed in a side-by-side relationship. As discussed above, a weatherable covering 32 may be provided on the exteriorly facing surface of the foam insulation member 109 and second flanges 108*b*. Similarly, the first flanges 108*a* are generally coplanar with the fire retarding board 116 to thereby provide a substantially planar surface along the lateral sides of the premanufactured structural building panels 13. If a more finished surface is desired, a finishing board 30 can be secured to the first flanges 108*a* using suitable fasteners.

As shown in FIG. 11, a security wall can be constructed using the building panels 13 of the present invention. In a preferred embodiment, the structural building panels used to form a sidewall 12 are constructed as described above, except that the thickness of the foam insulation members 19 is reduced over a section of the panels by approximately 1 to 2 inches. Preferably, the section of the panels, which corresponds to the height of the security wall, is approximately 8 feet in length. Once each building panel is constructed, the panel is positioned such that the exteriorly facing surface 33 of the foam insulation member is facing downward (upside down relative to FIG. 11). Advantageously, the reduction in thickness of the foam insulation member forms a cavity having a bottom defined by the fire retarding board 26, sides defined by the web portions 16 of the channels 14, and a partial top surface defined by the first flanges 18*a* of the channels. Reinforcing members 55 can be positioned within the cavity between the fire retarding board and the first flanges of the channels by tack welding such that the reinforcing members extend between the web portions of the channels. The reinforcing members are preferably #3 or #4 reinforcing bar. A layer of substantially liquid cementitious material 56, such as lightweight concrete, can then be poured over the reinforcing members such that the liquid cementitious material fills the cavity between the fire retarding board and the first flanges of the channels. Formwork can be applied to the end of the building panel to maintain the cementitious material within the cavity. Once dry, the cementitious material will form a solid security layer or barrier retained between the fire retarding board and the first flanges of the channels. The building panels can then be installed to form a sidewall having a security wall of predetermined height. In an alternate embodiment, the fire retarding board and angle members may be omitted when forming the security wall such that the foam insulation member directly abuts the cementitious layer. In another alternate embodiment (not shown), the security wall can be constructed of flattened expanded metal sheets.

Figure 5:
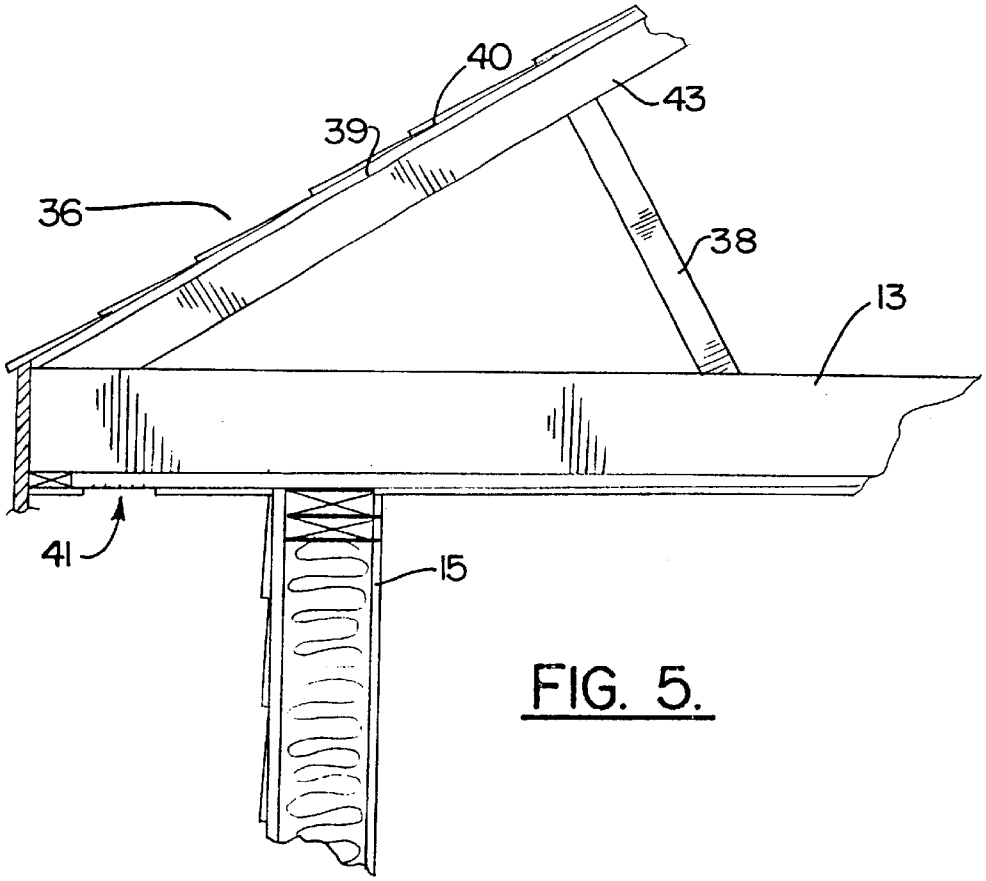
FIG. 5 is a plan view illustrating an embodiment of a premanufactured structural building panel system according to the present invention as used to form a residential roof system.
Figure 6:
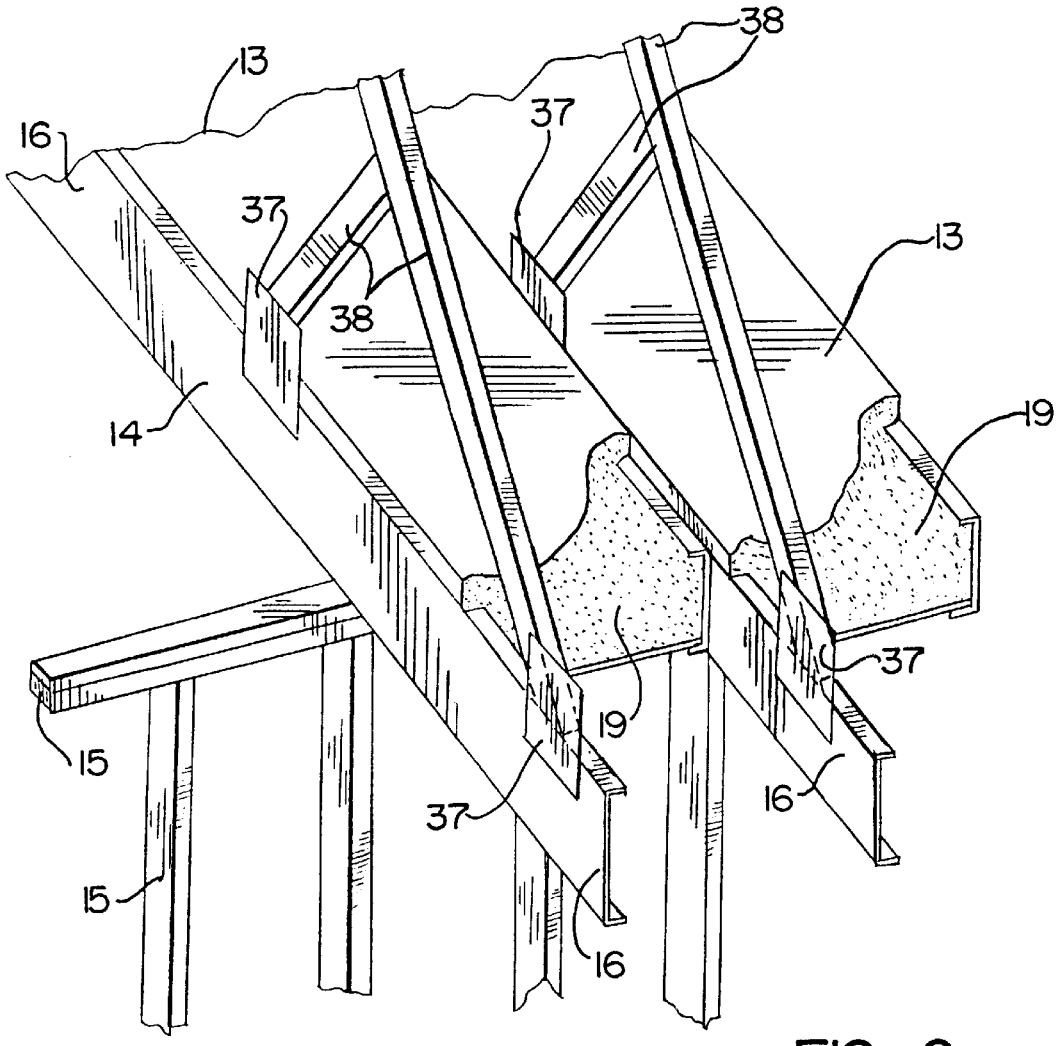
FIG. 6 is a partial perspective view illustrating an embodiment of a premanufactured structural building panel according to the present invention as used to form a residential roof system.

As shown in FIGS. 5 and 6, the premanufactured structural building panels 13 can also be used in the construction of a residential roof system 36. Such a roof system 36 can be used to span distances of 40–65 feet, with typical spans being from 30–32 feet. As before, the premanufactured structural building panels 13 extend between wall support members 15, preferably being positioned 2 feet on-center. The wall support members 15 also form the bearing wall for the roof trusses. The premanufactured structural building panels 13 include metal tabs 37, preferably of 14 gauge steel, attached to the web portions 16 of one or both of the structural channels 14 at predetermined points along the length of the premanufactured structural building panels 13. Above the premanufactured structural building panels 13, metal or wood truss members 38, 43 or alternatively, rafters and jack studs (not shown), are erected to support the exterior plywood sheathing 39 and weatherable covering 40. The truss members 38 or jack studs (not shown) are attached to the metal tabs 37 which act as truss point connections to provide structural support for the roof system 36. In addition, at least one of the two structural channels 14 of each of the premanufactured structural building panels 13 extends beyond the termination of the foam insulation member 19 and is connected to a jack stud or truss member 38 in order to provide additional support for the roof system 36. The overhanging structural channel 14 can later be used to construct a vented soffit 41 around the exterior of the building.

Figure 7:
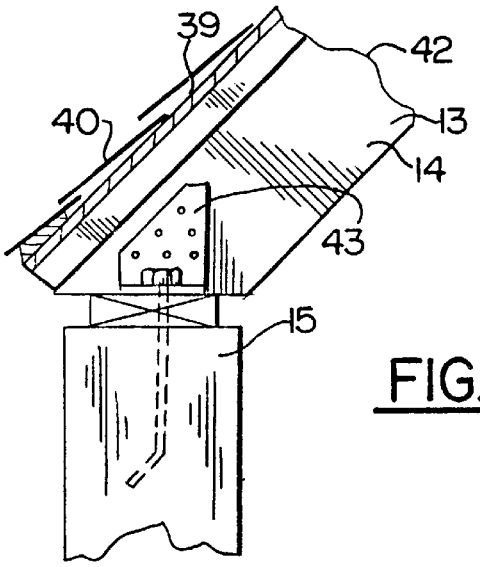
FIG. 7 is a plan view illustrating a premanufactured structural truss panel attached to a wall support member.

The premanufactured structural building panels 13 can also be used as premanufactured structural truss panels 42 in a slanted roof for forming cathedral-type ceilings. The premanufactured structural truss panels 42 are supported at a predetermined roof pitch by a wood or metal center beam (not shown) which extends along the apex of the roof. Where the premanufactured structural truss panels 42 intersect the wall support members 15, one or both of the structural channels 14 of each of the premanufactured structural truss panels is preferably attached to the wall support member through a metal joist panel 43 or angle iron (not shown) which provides additional support for the roof system 36. As illustrated in FIG. 7, the end of the premanufactured structural truss panel 42 is connected to the wall support member 15. However, the premanufactured structural truss panel may also extend past the wall support member 15 to form an overhang (not shown). In such an embodiment, the metal joist panel 43 attaches to the premanufactured structural truss panel along the length of the panel, at the intersection of the panel and the wall support member, rather than at the end of the truss panel.

Sub-purlins (not shown) can be attached to the exteriorly facing surface of the premanufactured structural truss panels 42 in order to create an air space between the exteriorly facing surface and the weatherable covering 40. Exterior plywood sheathing 38 can then be attached to the sub-purlins. A weatherable covering 40 is then secured to the exterior surface of the sheathing 39. Preferably, the weatherable covering 40 will include a roofing felt and roof shingles, such as asphalt or wood shingles.

Use of the premanufactured structural building panels 13 in residential roof systems 36 provides several advantages. The structural channels 14 of the roof system 36 are protected from any water or moisture which is able to get behind the weatherable covering 40 by the foam insulation members 19. Moreover, the foam insulation members 19 provide an improved insulation value over conventional blown fiberglass or batt insulation by further restricting convective heat transfer.

In the drawings and the specification, there has been set forth preferred embodiments of the invention and, although specific terms are employed, the terms are used in a generic and descriptive sense only and not for purpose of limitation, the scope of the invention being set forth in the following claims. It is intended that the various embodiments of the invention can be made to incorporate any of the features of the other embodiments described above.

That which is claimed is:

1. An insulated building comprising:

a plurality of wall support members;

a plurality of wall members supported by said wall support members, each of said wall members formed from a plurality of premanufactured structural building panels each comprising;

a pair of structural channels extending longitudinally between said support members, each of said channels having a generally C-shaped cross section defined by a web portion having a laterally outer surface defining a plane and by first and second flanges connected at opposite ends of said web portion, each of said flanges having first and second portions, said first portion extending from said web portion in a direction towards the other of said channels, said second portion extending from said first portion in a direction towards the other of said flanges of the same channel;

a foam insulation member extending between said web portions of said channels and having first and second oppositely facing surfaces, said first facing surface corresponding to said first flanges of said channels and said second facing surface corresponding to said second flanges of said channels, said first and second oppositely facing surfaces each adapted to engage said corresponding first and second flanges to thereby secure said channels to said foam insulation member; and each of said building panels being connected to said wall support members and arranged in a side-by-side relationship such that at least one of the web portions of said channels of each panel is in abutting contact with a web portion of a channel of an adjacent panel.

2. A building as defined in claim 1 wherein said first portions of said flanges of said channels define exteriorly facing surfaces that are generally coplanar with the corresponding facing surfaces of said foam insulation member.

3. A building as defined in claim 1 further comprising at least one fire retarding board connected to said first portion of at least one of said first flanges, said at least one fire retarding board having a surface facing the interior of the building and an opposite exteriorly facing surface.

4. A building as defined in claim 1 wherein the laterally outer surface of at least one of said web portions of said channels is in abutting contact with and connected to the corresponding laterally outer surface of the web portion of an adjacent channel.

5. A building as defined in claim 1 wherein at least one of said wall members includes a weatherable outer covering.

6. A building as defined in claim 5 wherein said weatherable outer covering comprises a material selected from the group consisting of weatherable plaster, an elastomeric skin; an acrylic layer and roof shingles.

7. A building as defined in claim 1 wherein said web portion of at least one of said channels defines an aperture.

8. An insulated building comprising:

a plurality of wall support members;

a plurality of wall members supported by said wall support members, each of said wall members formed from a plurality of premanufactured structural building panels each comprising;

a pair of structural channels extending longitudinally between said support members, each of said channels having a generally C-shaped cross section defined by a web portion having a laterally outer surface defining a plane and by first and second flanges connected at opposite ends of said web portion, said first flanges extending from the respective web portions in a direction towards the other of said channels, said second flanges having first and second portions, said first portion of each of said second flanges extending from said web portion in a direction towards the other of said channels, said second portion of each of said second flanges extending from said first portion in a direction towards said first flange of the same channel;

third flanges extending from said web portions of each of said channels between said first and second flanges, said third flanges extending from said web portion in a direction towards the other of said channels;

at least one fire retarding board having lateral side edges extending between said web portions of said channels adjacent said first flanges of said channels such that said lateral side edges are engaged between said first and third flanges, said at least one fire retarding board having a surface facing the interior of the building and an opposite exteriorly facing surface;

a foam insulation member extending between said web portions of said channels and having an interiorly facing surface adjacent said at least one fire retarding board and an opposite exteriorly facing surface, said exteriorly facing surface being adapted to engage said second flanges to thereby secure said channels to said foam insulation member; and each of said building panels being connected to said wall support members and arranged in a side-by-side relationship such that at least one of the web portions of said channels of each panel is in abutting contact with a web portion of a channel of an adjacent panel.

9. A building as defined in claim 8 wherein said first portions of said second flanges of said channels define exteriorly facing surfaces that are generally coplanar with the exteriorly facing surface of said foam insulation member.

10. A building as defined in claim 8 wherein said fire retarding board comprises gypsum coreboard.

11. A building as defined in claim 8 wherein said building panels further comprise at least one sound attenuating board having a surface facing the interior of the building and an opposite exteriorly facing surface adjacent said at least one fire retarding board.

12. A building as defined in claim 8 wherein the laterally outer surface of at least one of said web portions of said channels is in abutting contact with and connected to the corresponding laterally outer surface of the web portion of an adjacent channel.

13. A building as defined in claim 8 wherein at least one of said wall members includes a weatherable outer covering.

14. A building as defined in claim 13 wherein said weatherable outer covering comprises a material selected from the group consisting of weatherable plaster, an elastomeric skin; an acrylic layer and roof shingles.

15. A building as defined in claim 8 wherein said web portion of at least one of said channels defines an aperture.

16. A building as defined in claim 8 wherein said third flanges have first and second portions, said first portion of each of said third flanges extending from said web portion in a direction towards the other of said channels, said second portion of each of said third flanges extending from said first portion in a direction toward said second flange of the same channel; and wherein said exteriorly facing surface of said foam insulation member being adapted to engage said third flanges.

17. An insulated building comprising:

a plurality of wall support members;

a plurality of wall members supported by said wall support members, each of said wall members formed from a plurality of premanufactured structural building panels each comprising;

a pair of structural channels extending longitudinally between said support members, each of said channels having a generally C-shaped cross section defined by a web portion having a laterally outer surface defining a plane and by first and second flanges connected at opposite ends of said web portion, said first flanges extending from the respective web portions in a direction towards the other of said channels, said second flanges having first and second portions, said first portion of each of said second flanges extending from said web portion in a direction towards the other of said channels, said second portion of each of said second flanges extending from said first portion in a direction towards said first flange of the same channel;

at least one retaining member extending between said web portions of each of said channels between said first and second flanges;

at least one fire retarding board having lateral side edges extending between said web portions of said channels adjacent said first flanges of said channels such that said lateral side edges are engaged between said first flanges and said at least one retaining member, said at least one fire retarding board having a surface facing the interior of the building and an opposite exteriorly facing surface;

a foam insulation member extending between said web portions of said channels and having an interiorly facing surface adjacent said at least one fire retarding board and an opposite exteriorly facing surface, said exteriorly facing surface being adapted to engage said second flanges to thereby secure said channels to said foam insulation member; and each of said building panels being connected to said wall support members and arranged in a side-by-side relationship such that at least one of the web portions of said channels of each panel is in abutting contact with a web portion of a channel of an adjacent panel.

18. A building as defined in claim 17 wherein said first portions of said second flanges of said channels define exteriorly facing surfaces that are generally coplanar with the corresponding exteriorly facing surface of said foam insulation member.

19. A building as defined in claim 17 wherein said fire retarding board comprises gypsum coreboard.

20. A building as defined in claim 17 wherein said building panels further comprise at least one sound attenuating board having a surface facing the interior of the building and an opposite exteriorly facing surface adjacent said at least one fire retarding board.

21. A building as defined in claim 17 wherein the laterally outer surface of at least one of said web portions of said channels is in abutting contact with and connected to the corresponding laterally outer surface of the web portion of an adjacent channel.

22. A building as defined in claim 17 wherein at least one of said wall members includes a weatherable outer covering.

23. A building as defined in claim 22 wherein said weatherable outer covering comprises a material selected from the group consisting of weatherable plaster, an elastomeric skin; an acrylic layer and roof shingles.

24. A building as defined in claim 17 wherein said web portion of at least one of said channels defines an aperture.

25. A premanufactured structural building panel for forming an insulated wall member of a building, said panel comprising:

a pair of structural channels extending longitudinally, each of said channels having a generally C-shaped cross section defined by a web portion having a laterally outer surface defining a plane and by first and second flanges connected at opposite ends of said web portion, each of said flanges having first and second portions, said first portion extending from said web portion in a direction towards the other of said channels, said second portion extending from said first portion in a direction towards the other of said flanges of the same channel; and a foam insulation member extending between said web portions of said channels and having first and second oppositely facing surfaces, said first facing surface corresponding to said first flanges of said channels and said second facing surface corresponding to said second flanges of said channels, said first and second oppositely facing surfaces each adapted to engage said corresponding first and second flanges to thereby secure said channels to said foam insulation member.

26. A building panel as defined in claim 25 wherein said first portions of said flanges of said channels are generally coplanar with said corresponding facing surfaces of said foam insulation member.

27. A building panel as defined in claim 25 wherein the web portion of at least one of said channels defines an aperture.

28. A building panel as defined in claim 25 wherein the building panel forms a sidewall member.

29. A building panel as defined in claim 25 wherein the building panel forms a ceiling and roof wall member.

30. A building panel as defined in claim 25 wherein said foam insulation member is formed from a material selected from the group consisting of polyurethane, polystyrene, polypropylene, polyisocyanurate and polyethylene.

31. A premanufactured structural building panel for forming an insulated wall member of a building, said panel comprising:

a pair of structural channels extending longitudinally between said support members, each of said channels having a generally C-shaped cross section defined by a web portion having a laterally outer surface defining a plane and by first and second flanges connected at opposite ends of said web portion, said first flanges extending from the respective web portions in a direction towards the other of said channels, said second flanges having first and second portions, said first portion of each of said second flanges extending from said web portion in a direction towards the other of said channels, said second portion of each of said second flanges extending from said first portion in a direction towards said first flange of the same channel;

third flanges extending from said web portions of each of said channels between said first and second flanges, said third flanges extending from said web portion in a direction towards the other of said channels;

at least one fire retarding board having lateral side edges extending between said web portions of said channels adjacent said first flanges of said channels such that said lateral side edges are engaged between said first and third flanges, said at least one fire retarding board having a surface facing the interior of the building and an opposite exteriorly facing surface; and a foam insulation member extending between said web portions of said channels and having an interiorly facing surface adjacent said at least one fire retarding board and an opposite exteriorly facing surface, said exteriorly facing surface being adapted to engage said second flanges to thereby secure said channels to said foam insulation member.

32. A building panel as defined in claim 31 wherein said first portions of said second flanges of said channels are generally coplanar with said corresponding facing surfaces of said foam insulation member.

33. A building panel as defined in claim 31 wherein the web portion of at least one of said channels defines an aperture.

34. A building panel as defined in claim 31 wherein said fire retarding board comprises gypsum coreboard.

35. A building panel as defined in claim 31 further comprising at least one sound attenuating board having a surface facing the interior of the building and an opposite exteriorly facing surface adjacent said at least one fire retarding board.

36. A building panel as defined in claim 31 wherein the building panel forms a sidewall member.

37. A building panel as defined in claim 31 wherein the building panel forms a ceiling and roof wall member.

38. A building panel as defined in claim 31 wherein said foam insulation member is formed from a material selected from the group consisting of polyurethane, polystyrene, polypropylene, polyisocyanurate and polyethylene.

39. A building panel as defined in claim 31 wherein said third flanges have first and second portions, said first portion of each of said third flanges extending from said web portion in a direction towards the other of said channels, said second portion of each of said third flanges extending from said first portion in a direction towards said second flange of the same channel; and wherein said exteriorly facing surface of said foam insulation member being adapted to engage said third flanges.

40. A premanufactured structural building panel for forming an insulated wall member of a building, said panel comprising:

a pair of structural channels extending longitudinally between said support members, each of said channels having a generally C-shaped cross section defined by a web portion having a laterally outer surface defining a plane and by first and second flanges connected at opposite ends of said web portion, said first flanges extending from the respective web portions in a direction towards the other of said channels, said second flanges having first and second portions, said first portion of each of said second flanges extending from said web portion in a direction towards the other of said channels, said second portion of each of said second flanges extending from said first portion in a direction towards said first flange of the same channel;

at least one retaining member extending between said web portions of each of said channels between said first and second flanges;

at least one fire retarding board having lateral side edges extending between said web portions of said channels adjacent said first flanges of said channels such that said lateral side edges are engaged between said first flanges and said at least one retaining member, said at least one fire retarding board having a surface facing the interior of the building and an opposite exteriorly facing surface; and a foam insulation member extending between said web portions of said channels and having an interiorly facing surface adjacent said at least one fire retarding board and an opposite exteriorly facing surface, said exteriorly facing surface being adapted to engage said second flanges to thereby secure said channels to said foam insulation member.

41. A building panel as defined in claim 40 wherein said first portions of said second flanges of said channels are generally coplanar with said corresponding facing surfaces of said foam insulation member.

42. A building panel as defined in claim 40 wherein the web portion of at least one of said channels defines an aperture.

43. A building panel as defined in claim 40 wherein said fire retarding board comprises gypsum coreboard.

44. A building panel as defined in claim 40 further comprising at least one sound attenuating board having a surface facing the interior of the building and an opposite exteriorly facing surface adjacent said at least one fire retarding board.

45. A building panel as defined in claim 40 wherein the building panel forms a sidewall member.

46. A building panel as defined in claim 40 wherein the building panel forms a ceiling and roof wall member.

47. A building panel as defined in claim 40 wherein said foam insulation member is formed from a material selected from the group consisting of polyurethane, polystyrene, polypropylene, polyisocyanurate and polyethylene.

48. A method of manufacturing an insulated structural building panel comprising:

positioning a pair of longitudinally extending structural channels adjacent to one another to define part of an at least partially enclosed space, at least one of said flanges of each channel having first and second portions, said first portion extending from said corresponding web portion in a direction towards the other of said channels, said second portion extending from said first portion in a direction towards the other of said flanges of the same channel;

positioning at least one form adjacent to the channels to thereby define an at least partially enclosed space;

inserting an insulating foam into the at least partially enclosed space defined by the at least one form and the channels; and holding the at least one form in place adjacent the channels until the insulating foam has cured to thereby secure the channels to the foam insulation.

49. A method of manufacturing a structural building panel as defined in claim 48 further comprising removing the at least one form from the channels.

50. A method of manufacturing a structural building panel as defined in claim 48 wherein said inserting step comprises injecting the insulating foam through an aperture defined by the web portion of one of the channels and allowing the insulating foam to expand.

51. A method of manufacturing a structural building panel as defined in claim 48 wherein said inserting step comprises injecting the insulating foam through an aperture defined by the at least one form.

52. A method of manufacturing an insulated structural building panel comprising:

securing a pair of longitudinally extending angle members along opposite edges of the first side of a fire retarding board;

positioning a pair of longitudinally extending structural channels adjacent to one another;

placing the fire retarding board and angle members between the pair of longitudinally extending structural channels such that the fire retarding board extends between the channels to thereby define part of an at least partially enclosed space;

positioning at least one form adjacent to the channels to thereby define an at least partially enclosed space;

inserting an insulating foam into the at least partially enclosed space defined by the at least one form and the channels; and holding the at least one form in place adjacent the channels until the insulating foam has cured to thereby secure the channels to the foam insulation.

53. A method of manufacturing a structural building panel as defined in claim 52 further comprising removing the at least one form from the channels.

54. A method of manufacturing a structural building panel as defined in claim 52 wherein said inserting step comprises injecting the insulating foam through an aperture defined by the web portion of one of the channels and allowing the insulating foam to expand.

55. A method of manufacturing a structural building panel as defined in claim 52 wherein said inserting step comprises injecting the insulating foam through an aperture defined by the at least one form.

56. A method of manufacturing an insulated structural building panel comprising:

securing at least one retaining member along a lateral side of a fire retarding board;

positioning a pair of longitudinally extending structural channels adjacent to one another;

placing the fire retarding board and at least one retaining member between the pair of longitudinally extending structural channels such that the fire retarding board and at least one retaining member extend between the channels to thereby define part of an at least partially enclosed space;

positioning at least one form adjacent to the channels to thereby define an at least partially enclosed space;

inserting an insulating foam into the at least partially enclosed space defined by the at least one form and the channels; and holding the at least one form in place adjacent the channels until the insulating foam has cured to thereby secure the channels to the foam insulation.

57. A method of manufacturing a structural building panel as defined in claim 56 further comprising removing the at least one form from the channels.

58. A method of manufacturing a structural building panel as defined in claim 56 wherein said inserting step comprises injecting the insulating foam through an aperture defined by the web portion of one of the channels and allowing the insulating foam to expand.

59. A method of manufacturing a structural building panel as defined in claim 56 wherein said inserting step comprises injecting the insulating foam through an aperture defined by the at least one form.

* * * * *